US009386812B2

(12) United States Patent
Turner

(10) Patent No.: US 9,386,812 B2
(45) Date of Patent: Jul. 12, 2016

(54) ARTICLES OF APPAREL INCORPORATING CUSHIONING ELEMENTS

(75) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1025 days.

(21) Appl. No.: 13/189,716

(22) Filed: Jul. 25, 2011

(65) Prior Publication Data

US 2013/0025035 A1 Jan. 31, 2013

(51) Int. Cl.
*A41D 13/05* (2006.01)

(52) U.S. Cl.
CPC ..... *A41D 13/0593* (2013.01); *A41D 13/05* (2013.01)

(58) Field of Classification Search
CPC ..... A41D 13/0593; A41D 13/05
USPC ..... 2/267, 268, 23, 24, 411, 414, 455
See application file for complete search history.

(56) References Cited

U.S. PATENT DOCUMENTS

| | | | | |
|---|---|---|---|---|
| 921,352 | A | 5/1909 | Blaker et al. | |
| 1,282,411 | A | 10/1918 | Golembiowski | |
| 1,685,825 | A * | 10/1928 | Mullins | 2/462 |
| 1,910,810 | A | 5/1933 | Nash | |
| 1,924,677 | A | 8/1933 | Cadgéne | |
| 2,266,886 | A | 8/1940 | McCoy | |
| 2,569,398 | A | 9/1951 | Burd et al. | |
| 2,723,214 | A | 11/1955 | Meyer | |
| 2,738,834 | A | 3/1956 | Jaffe et al. | |
| 2,751,609 | A | 6/1956 | Oesterling et al. | |
| 2,785,739 | A | 3/1957 | McGregor, Jr. et al. | |
| 3,012,926 | A | 12/1961 | Wintermute et al. | |
| 3,020,186 | A | 2/1962 | Lawrence | |
| 3,119,904 | A * | 1/1964 | Anson | 381/378 |
| 3,137,746 | A | 6/1964 | Seymour et al. | |
| 3,233,885 | A | 2/1966 | Propst | |
| 3,258,800 | A | 7/1966 | Robinsky | |
| 3,285,768 | A * | 11/1966 | Habib | 428/160 |
| 3,293,671 | A | 12/1966 | Griffin | |
| 3,305,423 | A | 2/1967 | Le Masson | |
| 3,404,406 | A | 10/1968 | Balliet | |
| 3,441,638 | A | 4/1969 | Patchell et al. | |
| 3,465,364 | A | 9/1969 | Edelson | |
| 3,471,865 | A | 10/1969 | Molitoris | |
| 3,484,974 | A | 12/1969 | Culmone | |

(Continued)

FOREIGN PATENT DOCUMENTS

| | | |
|---|---|---|
| CA | 892301 | 2/1972 |
| CA | 2063814 | 1/1991 |

(Continued)

OTHER PUBLICATIONS

International Preliminary Report on Patentability dated Dec. 11, 2014 in PCT Application No. PCT/US2013/043225, 8 pages.

(Continued)

*Primary Examiner* — Danny Worrell
(74) *Attorney, Agent, or Firm* — Shook, Hardy & Bacon L.L.P.

(57) ABSTRACT

Cushioning elements for apparel may include a pair of material layers and a pad component that is located between and secured to the material layers. At least one surface of the pad component includes a plurality of grooves. In some configurations, both surfaces include the grooves. Moreover, the grooves may be elongate and extend at least partially across the pad component.

29 Claims, 42 Drawing Sheets

(56) References Cited

U.S. PATENT DOCUMENTS 3,500,472 A 3/1970 Castellani
3,512,190 A 5/1970 Buff
3,515,625 A 6/1970 Sedlak et al.
3,679,263 A 7/1972 Cadiou
3,722,355 A 3/1973 King
3,746,602 A 7/1973 Caroli et al.
3,746,605 A 7/1973 Dillon et al.
3,775,526 A 11/1973 Gilmore
3,832,265 A 8/1974 Denommee
3,843,970 A * 10/1974 Marietta et al. ..... 2/415
3,867,238 A 2/1975 Johannsen
3,867,239 A 2/1975 Alesi et al.
3,882,547 A 5/1975 Morgan
3,911,185 A 10/1975 Wright, Jr.
3,914,487 A 10/1975 Azoulay
3,922,329 A 11/1975 Kim et al.
3,950,789 A 4/1976 Konz
3,977,406 A 8/1976 Roth
4,023,213 A 5/1977 Rovani
4,126,177 A 11/1978 Smith et al.
4,136,222 A 1/1979 Jonnes
4,138,283 A 2/1979 Hanusa
4,146,933 A * 4/1979 Jenkins et al. ..... 2/458
4,190,696 A 2/1980 Hart et al.
4,197,342 A 4/1980 Bethe
4,249,268 A 2/1981 Berler
4,249,302 A 2/1981 Crepeau
4,255,552 A 3/1981 Schollenberger et al.
4,272,850 A 6/1981 Rule
4,276,341 A 6/1981 Tanaka
4,322,858 A 4/1982 Douglas
4,345,958 A 8/1982 Kuroda
4,370,754 A * 2/1983 Donzis ..... 2/463
4,384,369 A 5/1983 Prince
4,407,497 A 10/1983 Gracie
4,415,622 A 11/1983 Kamat
4,422,183 A 12/1983 Landi et al.
4,440,525 A 4/1984 Perla
4,482,592 A 11/1984 Kramer
4,485,919 A 12/1984 Sandel
4,493,865 A 1/1985 Kuhlmann et al.
4,507,801 A 4/1985 Kavanagh et al.
4,512,037 A 4/1985 Vacanti
4,516,273 A 5/1985 Gregory et al.
4,525,875 A 7/1985 Tomczak
4,534,354 A 8/1985 Bonner, Jr. et al.
4,538,301 A 9/1985 Sawatzki et al.
4,559,251 A 12/1985 Wachi
4,573,456 A * 3/1986 Spann ..... 602/27
4,581,186 A 4/1986 Larson
4,631,221 A 12/1986 Disselbeck et al.
4,642,814 A 2/1987 Godfrey
4,646,367 A 3/1987 El Hassen
4,685,155 A * 8/1987 Fingerhut et al. ..... 2/272
4,688,269 A 8/1987 Maeshima
4,692,199 A 9/1987 Kozlowski et al.
4,696,066 A 9/1987 Ball
4,713,854 A 12/1987 Graebe
4,718,214 A 1/1988 Waggoner
4,726,087 A * 2/1988 Schaefer et al. ..... 5/636
4,730,761 A 3/1988 Spano
4,734,306 A 3/1988 Lassiter
4,756,026 A 7/1988 Pierce, Jr.
4,774,724 A 10/1988 Sacks
4,780,167 A 10/1988 Hill
4,788,972 A * 12/1988 DeBusk ..... 602/5
4,809,374 A 3/1989 Saviez
4,815,149 A 3/1989 Erhardt et al.
4,852,274 A 8/1989 Wilson
4,856,393 A 8/1989 Braddon
4,866,800 A 9/1989 Bedford
4,867,826 A 9/1989 Wayte
4,884,295 A 12/1989 Cox
4,964,936 A 10/1990 Ferro
4,982,447 A 1/1991 Henson
4,985,931 A * 1/1991 Wingo, Jr. ..... 2/462
4,985,933 A 1/1991 Lemoine
4,989,265 A 2/1991 Nipper et al.
4,991,230 A 2/1991 Vacanti
5,007,111 A 4/1991 Adams
5,020,156 A 6/1991 Neufalfen
5,020,157 A 6/1991 Dyer
5,029,341 A 7/1991 Wingo, Jr.
5,030,501 A 7/1991 Colvin et al.
5,042,318 A 8/1991 Franz
5,048,123 A 9/1991 Monson
5,048,125 A 9/1991 Libertini et al.
5,052,053 A 10/1991 Peart et al.
5,054,127 A 10/1991 Zevchak
5,060,313 A 10/1991 Neuhalfen
5,071,698 A 12/1991 Scheerder et al.
5,129,295 A 7/1992 Geffros et al.
5,136,726 A 8/1992 Kellin et al.
5,146,621 A * 9/1992 Hadar et al. ..... 2/462
5,160,785 A 11/1992 Davidson, Jr.
5,168,576 A 12/1992 Krent et al.
5,188,879 A 2/1993 Hill et al.
5,214,797 A 6/1993 Tisdale
5,232,762 A 8/1993 Ruby
5,233,767 A 8/1993 Kramer
5,274,846 A 1/1994 Kolsky
5,289,830 A 3/1994 Levine
5,322,730 A 6/1994 Ou
5,325,537 A 7/1994 Marion
5,334,082 A 8/1994 Barker
5,349,893 A 9/1994 Dunn
5,353,455 A 10/1994 Loving et al.
5,360,653 A 11/1994 Ackley
5,380,392 A 1/1995 Imamura et al.
5,399,418 A 3/1995 Hartmanns et al.
5,405,665 A 4/1995 Shukushima et al.
5,407,421 A 4/1995 Goldsmith
5,423,087 A 6/1995 Krent et al.
5,427,563 A 6/1995 Manning
5,452,477 A 9/1995 Mann
5,454,743 A 10/1995 Simonson
5,459,896 A 10/1995 Raburn et al.
5,477,558 A 12/1995 Völker et al.
5,484,448 A 1/1996 Steele et al.
5,496,610 A 3/1996 Landi et al.
5,530,966 A 7/1996 West
5,534,208 A 7/1996 Barr et al.
5,534,343 A 7/1996 Landi et al.
5,536,246 A 7/1996 Saunders
5,539,934 A 7/1996 Ponder
5,551,082 A 9/1996 Stewart et al.
5,594,954 A 1/1997 Huang
5,601,895 A 2/1997 Cunningham
5,614,301 A 3/1997 Katz
5,621,914 A 4/1997 Ramone et al.
5,628,063 A 5/1997 Reed
5,633,055 A 5/1997 Weder et al.
5,636,377 A 6/1997 Wiener
5,640,712 A 6/1997 Hansen et al.
5,659,898 A 8/1997 Bell, Jr.
5,660,572 A 8/1997 Buck
5,675,844 A 10/1997 Guyton et al.
5,689,836 A 11/1997 Fee et al.
5,692,935 A 12/1997 Smith
5,697,101 A 12/1997 Aldridge
5,717,997 A 2/1998 Garcia
5,720,714 A 2/1998 Penrose
5,727,252 A 3/1998 Oetting et al.
5,729,832 A 3/1998 Grilliot et al.
5,734,991 A 4/1998 Schmid
5,738,925 A 4/1998 Chaput
5,742,939 A 4/1998 Williams
5,780,147 A 7/1998 Sugahara et al.
5,823,981 A 10/1998 Grim et al.
5,826,273 A 10/1998 Eckes
5,860,163 A 1/1999 Aldridge
5,887,453 A 3/1999 Woods
5,915,819 A 6/1999 Gooding
5,920,915 A 7/1999 Bainbridge et al.

(56) References Cited

U.S. PATENT DOCUMENTS

| | | | | |
|---|---|---|---|---|
| 5,938,878 | A | 8/1999 | Hurley et al. | |
| 5,940,888 | A | 8/1999 | Sher | |
| 5,953,757 | A | 9/1999 | Blanks | |
| 5,957,692 | A | 9/1999 | McCracken et al. | |
| 5,987,643 | A | 11/1999 | Beutler | |
| 6,005,222 | A | 12/1999 | Hicks | |
| 6,041,436 | A | 3/2000 | Keen | |
| 6,041,447 | A | 3/2000 | Endler | |
| 6,053,005 | A | 4/2000 | Boitnott | |
| 6,070,267 | A | 6/2000 | McKewin | |
| 6,070,273 | A | 6/2000 | Sgro | |
| 6,085,353 | A | 7/2000 | Van der Sleesen | |
| 6,093,468 | A | 7/2000 | Toms et al. | |
| 6,098,198 | A | 8/2000 | Jacobs et al. | |
| 6,105,162 | A | 8/2000 | Douglas et al. | |
| 6,139,928 | A | 10/2000 | Sloot | |
| 6,167,790 | B1 | 1/2001 | Bambara et al. | |
| 6,193,678 | B1 | 2/2001 | Brannon | |
| 6,219,852 | B1 | 4/2001 | Bain et al. | |
| 6,228,108 | B1 | 5/2001 | Lamb | |
| 6,235,661 | B1 | 5/2001 | Khanamirian | |
| 6,253,376 | B1 | 7/2001 | Ritter | |
| 6,289,524 | B1 | 9/2001 | Wright et al. | |
| 6,295,654 | B1 | 10/2001 | Farrell | |
| 6,301,722 | B1 | 10/2001 | Nickerson et al. | |
| 6,317,888 | B1 | 11/2001 | McFarlane | |
| 6,374,409 | B1 | 4/2002 | Galy | |
| 6,408,446 | B1 | 6/2002 | Carrington | |
| 6,453,477 | B1 | 9/2002 | Bainbridge et al. | |
| 6,484,325 | B1 | 11/2002 | Lazarus et al. | |
| 6,485,448 | B2 | 11/2002 | Lamping et al. | |
| 6,519,781 | B1 | 2/2003 | Berns | |
| 6,553,994 | B2 * | 4/2003 | Bard | 128/845 |
| 6,584,616 | B2 | 7/2003 | Godshaw et al. | |
| 6,654,960 | B2 | 12/2003 | Cho | |
| 6,654,962 | B2 | 12/2003 | DeMott | |
| 6,666,836 | B1 | 12/2003 | Islava | |
| 6,726,641 | B2 | 4/2004 | Chiang et al. | |
| 6,743,325 | B1 | 6/2004 | Taylor | |
| 6,817,039 | B1 | 11/2004 | Grilliot et al. | |
| 6,820,279 | B2 | 11/2004 | Lesosky | |
| 6,841,022 | B2 | 1/2005 | Tsukagoshi et al. | |
| 6,842,915 | B2 | 1/2005 | Turner et al. | |
| 6,851,124 | B2 | 2/2005 | Munoz et al. | |
| 6,936,021 | B1 | 8/2005 | Smith | |
| 6,968,573 | B2 | 11/2005 | Silver | |
| 6,969,548 | B1 | 11/2005 | Goldfine | |
| 6,982,115 | B2 | 1/2006 | Poulos et al. | |
| 7,007,356 | B2 | 3/2006 | Cudney et al. | |
| 7,018,351 | B1 | 3/2006 | Iglesias et al. | |
| 7,065,793 | B1 | 6/2006 | Wooten | |
| 7,114,189 | B1 | 10/2006 | Kleinert | |
| 7,135,007 | B2 * | 11/2006 | Scott et al. | 602/75 |
| 7,276,076 | B2 | 10/2007 | Bieberich | |
| 7,389,547 | B1 | 6/2008 | Wiens | |
| 7,506,384 | B2 | 3/2009 | Ide et al. | |
| RE41,346 | E | 5/2010 | Taylor | |
| RE42,689 | E | 9/2011 | Taylor | |
| 8,095,996 | B2 * | 1/2012 | Turner | 2/456 |
| RE43,441 | E | 6/2012 | Taylor | |
| 8,231,756 | B2 | 7/2012 | Kim | |
| 8,336,117 | B2 * | 12/2012 | Carter et al. | 2/87 |
| RE43,994 | E | 2/2013 | Taylor | |
| 8,438,669 | B2 * | 5/2013 | Turner | 2/456 |
| 8,561,214 | B2 * | 10/2013 | Turner | 2/267 |
| 8,578,512 | B2 * | 11/2013 | Moore et al. | 2/2.16 |
| 8,621,674 | B2 * | 1/2014 | Perreault et al. | 2/463 |
| 8,683,618 | B2 * | 4/2014 | Grogro et al. | 2/228 |
| 8,719,965 | B2 * | 5/2014 | Turner et al. | 2/228 |
| 8,764,931 | B2 * | 7/2014 | Turner | 156/299 |
| 8,931,119 | B2 * | 1/2015 | Gordon et al. | 2/455 |
| RE45,402 | E * | 3/2015 | Taylor | 428/304.4 |
| 2002/0184925 | A1 | 12/2002 | McClellan et al. | |
| 2003/0220048 | A1 | 11/2003 | Toro et al. | |
| 2003/0236053 | A1 | 12/2003 | Martz | |
| 2004/0019950 | A1 | 2/2004 | Rast | |
| 2005/0009445 | A1 | 1/2005 | Bell et al. | |
| 2005/0066407 | A1 | 3/2005 | Delaney | |
| 2005/0085162 | A1 | 4/2005 | Ott | |
| 2005/0161982 | A1 | 7/2005 | Cormier et al. | |
| 2005/0278817 | A1 | 12/2005 | Doheny | |
| 2006/0099884 | A1 | 5/2006 | Falla | |
| 2006/0137080 | A1 | 6/2006 | McCoy et al. | |
| 2006/0199456 | A1 | 9/2006 | Taylor | |
| 2006/0218692 | A1 | 10/2006 | Lamarque | |
| 2006/0234014 | A1 | 10/2006 | Liu et al. | |
| 2006/0260026 | A1 | 11/2006 | Doria et al. | |
| 2006/0277647 | A1 | 12/2006 | Dobkin | |
| 2007/0000005 | A1 | 1/2007 | Wang | |
| 2007/0106352 | A1 | 5/2007 | Carstens | |
| 2007/0185425 | A1 | 8/2007 | Einarsson et al. | |
| 2007/0186327 | A1 | 8/2007 | Hall et al. | |
| 2007/0186328 | A1 | 8/2007 | Bulian | |
| 2007/0250976 | A1 | 11/2007 | Beliveau | |
| 2008/0060113 | A1 | 3/2008 | Walsh | |
| 2008/0264557 | A1 | 10/2008 | Kim | |
| 2008/0282439 | A1 | 11/2008 | Sarkies | |
| 2008/0290556 | A1 | 11/2008 | Kim | |
| 2009/0070911 | A1 | 3/2009 | Chang | |
| 2010/0024101 | A1 | 2/2010 | Berner et al. | |
| 2010/0129573 | A1 | 5/2010 | Kim | |
| 2010/0192275 | A1 | 8/2010 | Riccelli | |
| 2010/0193117 | A1 | 8/2010 | Kim | |
| 2010/0205716 | A1 | 8/2010 | Kim | |
| 2010/0205722 | A1 | 8/2010 | Kim | |
| 2010/0206472 | A1 | 8/2010 | Kim | |
| 2010/0235960 | A1 | 9/2010 | Johnson | |
| 2011/0035864 | A1 | 2/2011 | Gordon et al. | |
| 2011/0061154 | A1 * | 3/2011 | Turner et al. | 2/455 |
| 2011/0209275 | A1 | 9/2011 | Berns et al. | |
| 2011/0252549 | A1 | 10/2011 | Jourde et al. | |
| 2013/0025036 | A1 | 1/2013 | Turner | |
| 2013/0025037 | A1 | 1/2013 | Turner | |
| 2013/0160179 | A1 | 6/2013 | Shiue | |

FOREIGN PATENT DOCUMENTS

| | | | |
|---|---|---|---|
| CA | 2162723 | | 11/1994 |
| CA | 2289622 | | 11/1998 |
| CH | 638665 | | 10/1983 |
| CN | 2225163 | | 4/1996 |
| CN | 2305870 | | 2/1999 |
| CN | 101385576 | A | 3/2009 |
| DE | 3119489 | | 12/1982 |
| DE | 3530397 | | 3/1987 |
| DE | 9102039 | | 2/1991 |
| DE | 4128958 | C2 | 3/1994 |
| DE | 4336468 | | 4/1995 |
| DE | 102005060624 | | 5/2007 |
| EP | 0552304 | | 7/1993 |
| EP | 0083454 | | 10/1998 |
| EP | 0595887 | | 12/1998 |
| EP | 0962156 | | 12/1999 |
| EP | 2436279 | A2 | 4/2012 |
| FR | 2740303 | | 4/1997 |
| FR | 2797153 | | 2/2001 |
| GB | 832101 | | 4/1960 |
| GB | 1274569 | | 5/1972 |
| GB | 2120167 | | 11/1983 |
| GB | 2177892 | | 2/1987 |
| GB | 2233877 | | 1/1991 |
| GB | 2385256 | | 8/2003 |
| JP | 1316235 | | 12/1989 |
| JP | 10337797 | | 12/1989 |
| JP | 2508289 | | 6/1994 |
| JP | H0790704 | A | 4/1995 |
| JP | 10053905 | | 2/1998 |
| KR | 101023817 | B1 | 3/2011 |
| KR | 20120046625 | A | 5/2012 |
| WO | WO9418861 | | 9/1994 |
| WO | WO9723142 | | 7/1997 |
| WO | 9733483 | A1 | 9/1997 |
| WO | WO9733403 | | 9/1997 |
| WO | WO9733493 | | 9/1997 |

(56) References Cited

FOREIGN PATENT DOCUMENTS

| | | | |
|---|---|---|---|
| WO | WO9736740 | | 10/1997 |
| WO | WO9934972 | | 7/1999 |
| WO | WO9935926 | | 7/1999 |
| WO | WO0050336 | | 8/2000 |
| WO | WO0103530 | | 1/2001 |
| WO | WO0115892 | | 3/2001 |
| WO | WO0216124 | | 2/2002 |
| WO | WO02081202 | | 10/2002 |
| WO | WO2004019713 | | 3/2004 |
| WO | WO2006036072 | | 4/2006 |
| WO | WO2006088734 | | 8/2006 |
| WO | 2009035888 | A2 | 3/2009 |
| WO | 2010076257 | A2 | 7/2010 |
| WO | 2010104868 | | 9/2010 |
| WO | 2011091361 | | 7/2011 |
| WO | WO2013015913 | | 1/2013 |
| WO | 2013154969 | | 10/2013 |

OTHER PUBLICATIONS

Chinese Office Action dated Dec. 18, 2014 with Search Report dated Dec. 9, 2014 in Application No. 20128000365211, 8 pages.

Andrew Alderson, "A Triumph of Lateral Thought", in Chemistry & Industry, May 17, 1999; pp. 384-391.

Maria Burke, "A Stretch of the Imagination", New Scientist Magazine, vol. 154 issue 2085, Jul. 6, 1997 at p. 36 (available from research.dh.umu.se/dynamic/artiklar/shape/stretch.html, last accessed Nov. 11, 2013).

Joseph Hamill & Carolyn K. Bensel, "Biomechanical Analysis of Military Boots: Phase III", in United States Army Technical Report NATICK/TR-96.013; dated Mar. 11, 1996; 42 pages.

International Search Report and Written Opinion in PCT Application No. PCT/US2009/050099, mailed May 27, 2010.

International Search Report and Written Opinion in PCT Application No. PCT/US2013/035576, mailed Jul. 19, 2013.

International Search Report and Written Opinion in PCT Application No. PCT/US2009/050860, mailed Jan. 26, 2010.

International Search Report and Written Opinion in PCT Application No. PCT/US2012/043171, mailed on Oct. 29, 2012.

European Examination Report dated Nov. 4, 2014 in Application No. 12746147.3, 4 pages.

Chinese Search Report dated Aug. 17, 2015 in Application No. 201380028943.9, 2 pages.

Chinese Office Action dated Aug. 25, 2015 in Application No. 201380028943.9, 7 pages.

Non-Final Office Action dated Feb. 12, 2015 in U.S. Appl. No. 13/485,739, 15 pages.

Non-Final Office Action dated May 6, 2015 in U.S. Appl. No. 13/442,537, 18 pages.

Final Office Action dated Aug. 3, 2015 in U.S. Appl. No. 13/485,739, 18 pages.

Final Office Action dated Nov. 20, 2015 in U.S. Appl. No. 13/442,537, 22 pages.

Canadian Office Action dated Feb. 11, 2016 in Application No. 2,868,502, 4 pages.

European Office Action dated Mar. 23, 2016 in Application No. 12746147.3, 3 pages.

Non-Final Office Action dated Mar. 11, 2016 in U.S. Appl. No. 13/442,537, 41 pages.

* cited by examiner

ARTICLES OF APPAREL INCORPORATING CUSHIONING ELEMENTS

BACKGROUND

Materials or elements that impart padding, cushioning, or otherwise attenuate impact forces are commonly incorporated into a variety of products. Athletic apparel, for example, often incorporates cushioning elements that protect the wearer from contact with other athletes, equipment, or the ground. More specifically, pads used in American football and hockey incorporate cushioning elements that provide impact protection to various parts of a wearer. Helmets utilized during American football, hockey, bicycling, skiing, snowboarding, and skateboarding incorporate cushioning elements that provide head protection during falls or crashes. Similarly, gloves utilized in soccer (e.g., by goalies) and hockey incorporate cushioning elements that provide protection to the hands of a wearer.

SUMMARY

Various cushioning elements that may be utilized in apparel and a variety of other products are disclosed below. In general, the cushioning elements include a pair of material layers and a pad component that is located between and secured to the material layers. At least one surface of the pad component includes a plurality of grooves. In some configurations, both surfaces include the grooves. Moreover, the grooves may be elongate and extend at least partially across the pad component.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of cushioning elements that may be incorporated into a variety of products, including articles of apparel, such as shorts, pants, shirts, wraps, footwear, gloves, and helmets.

Apparel Configuration

Figure 1:
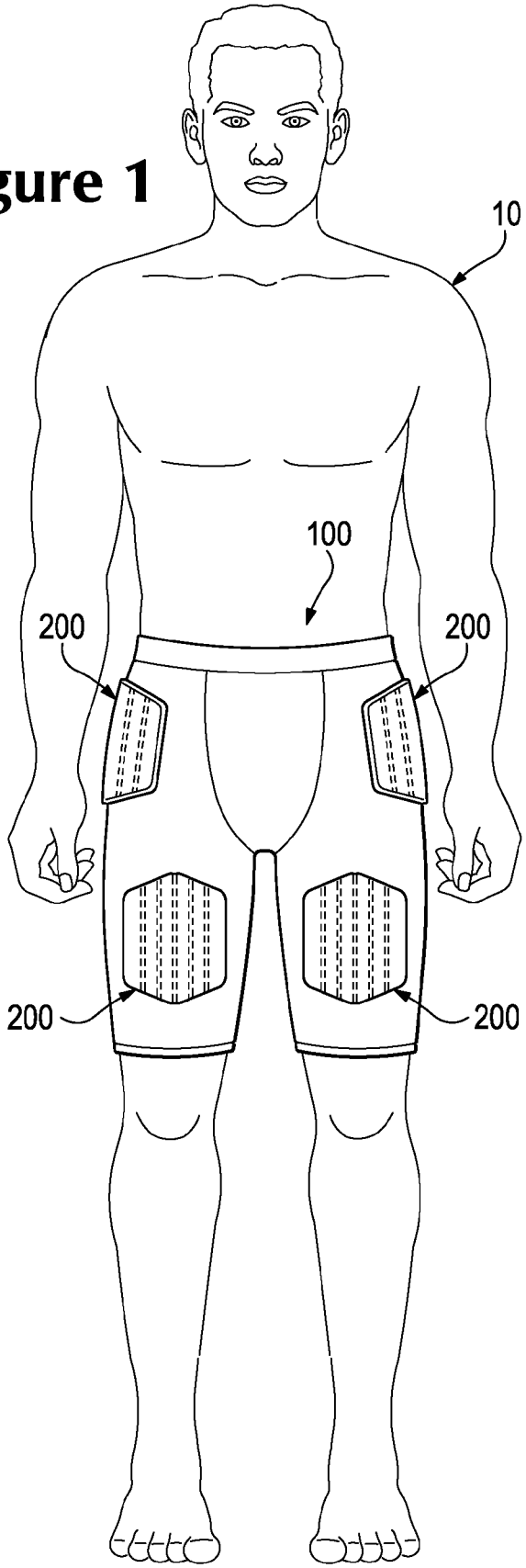
FIG. 1 is a front elevational view of an individual wearing an article of apparel.
Figure 2:
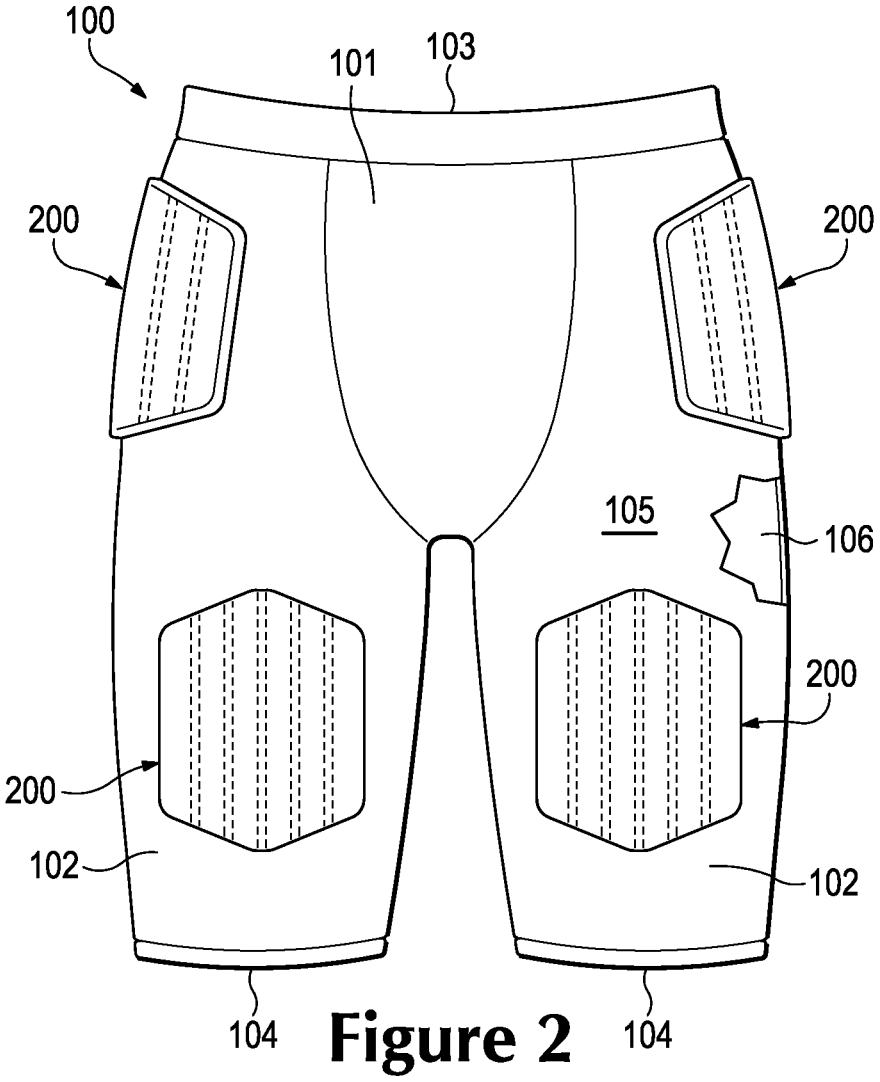
FIG. 2 is a front elevational view of the article of apparel.
Figure 3:
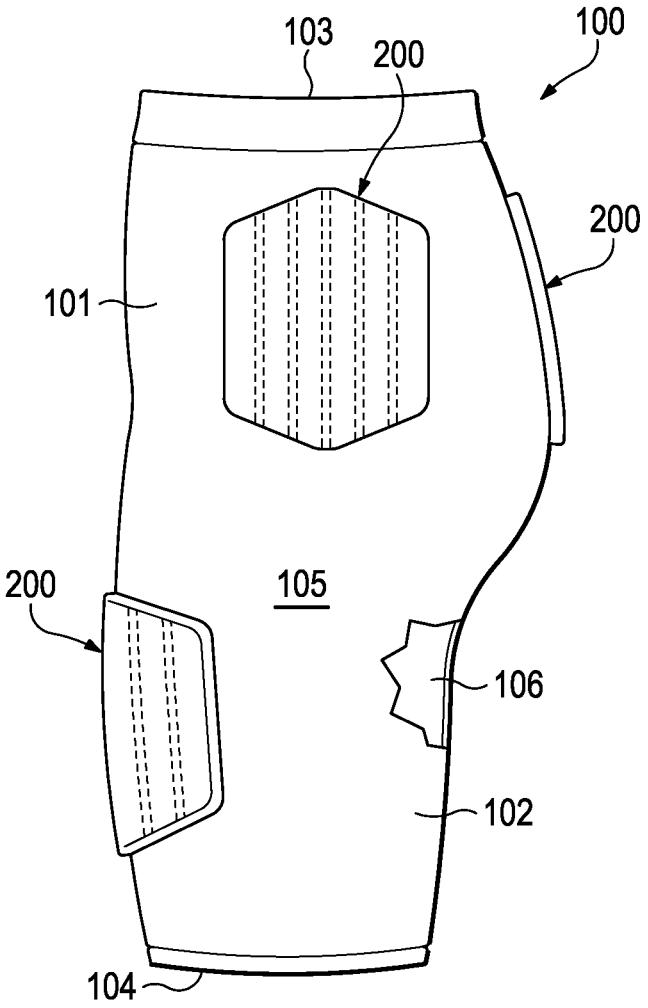
FIGS. 3 and 4 are side elevational views of the article of apparel.
Figure 4:
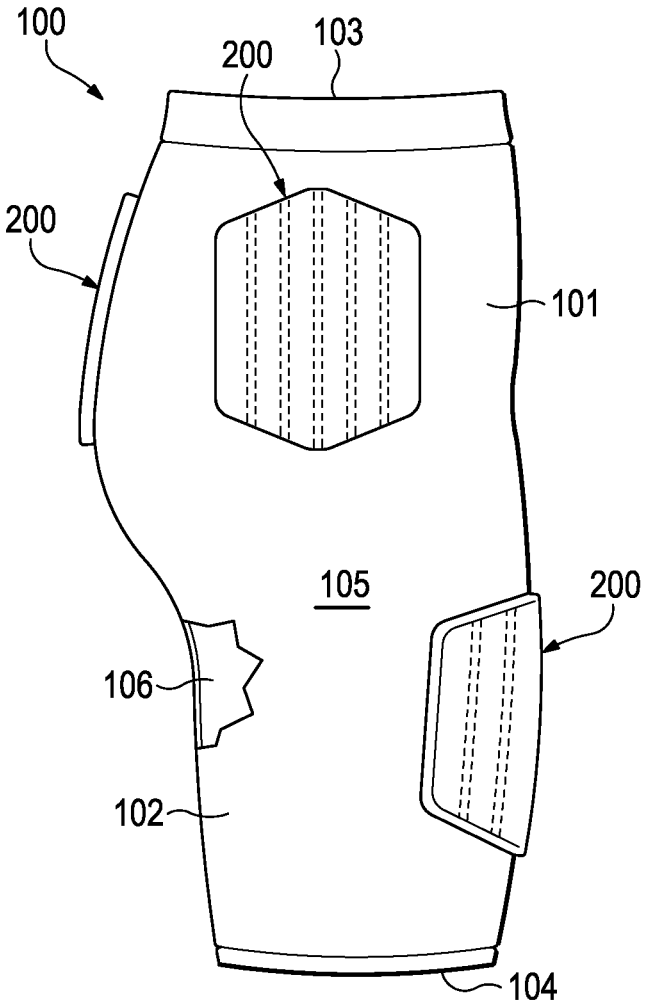
Figure 5:
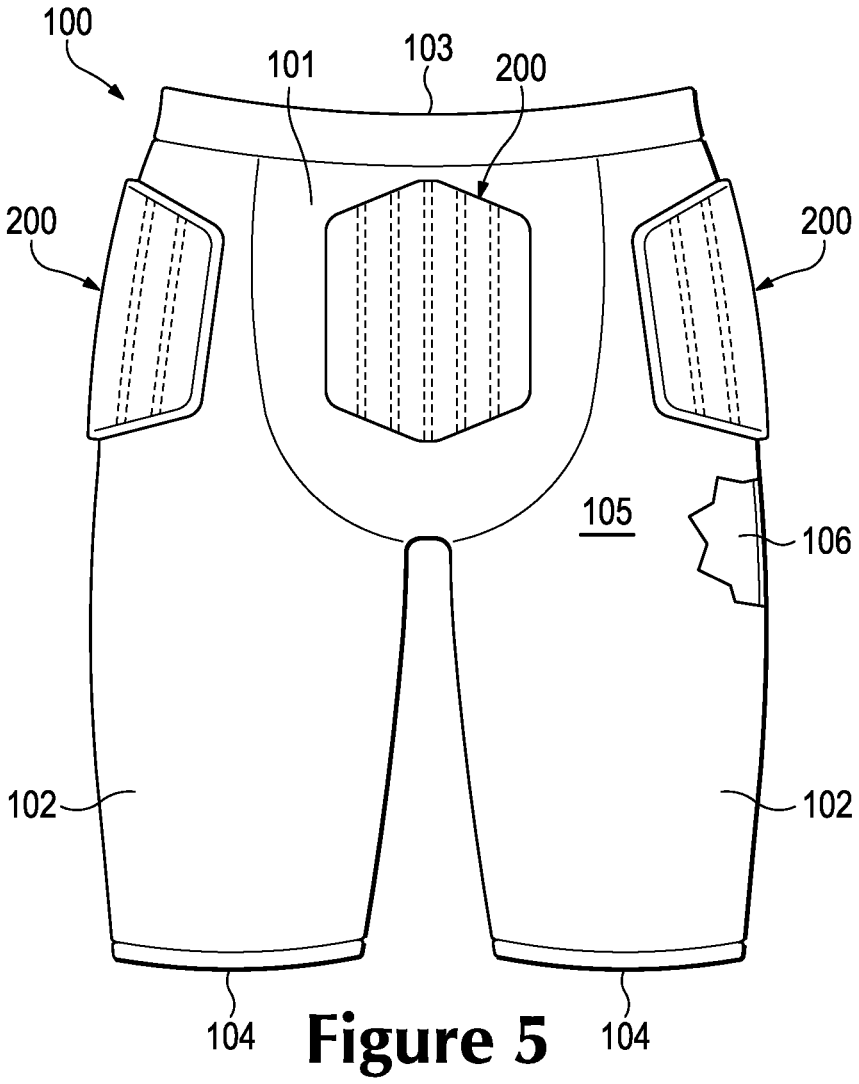
FIG. 5 is a rear elevational view of the article of apparel.
Figure 6:
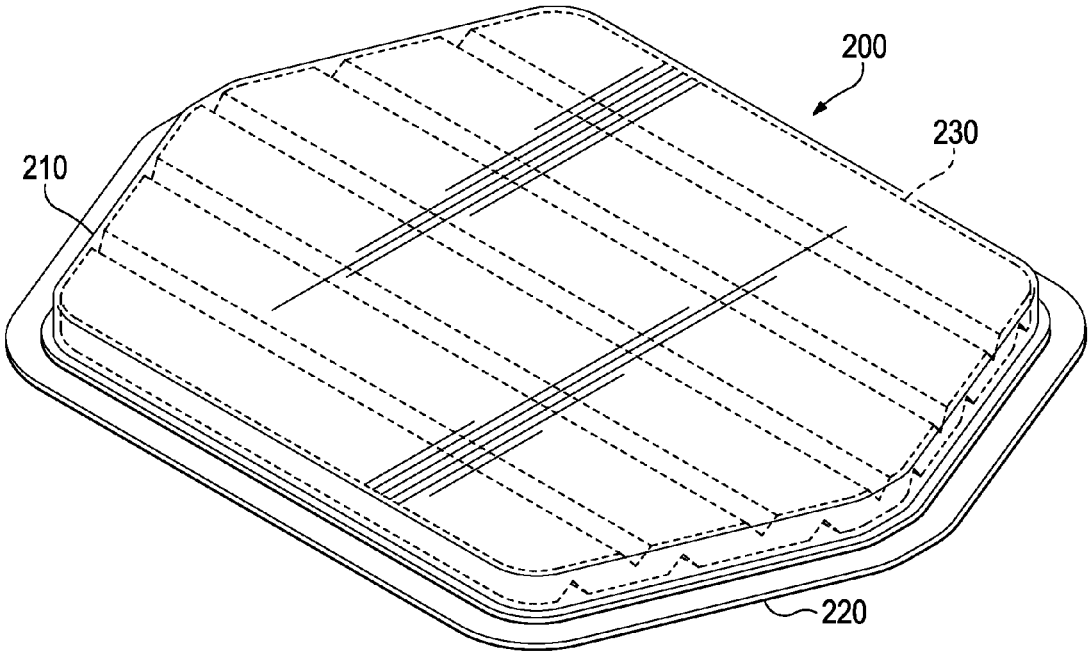
FIG. 6 is a perspective view of a cushioning element.
Figure 7:
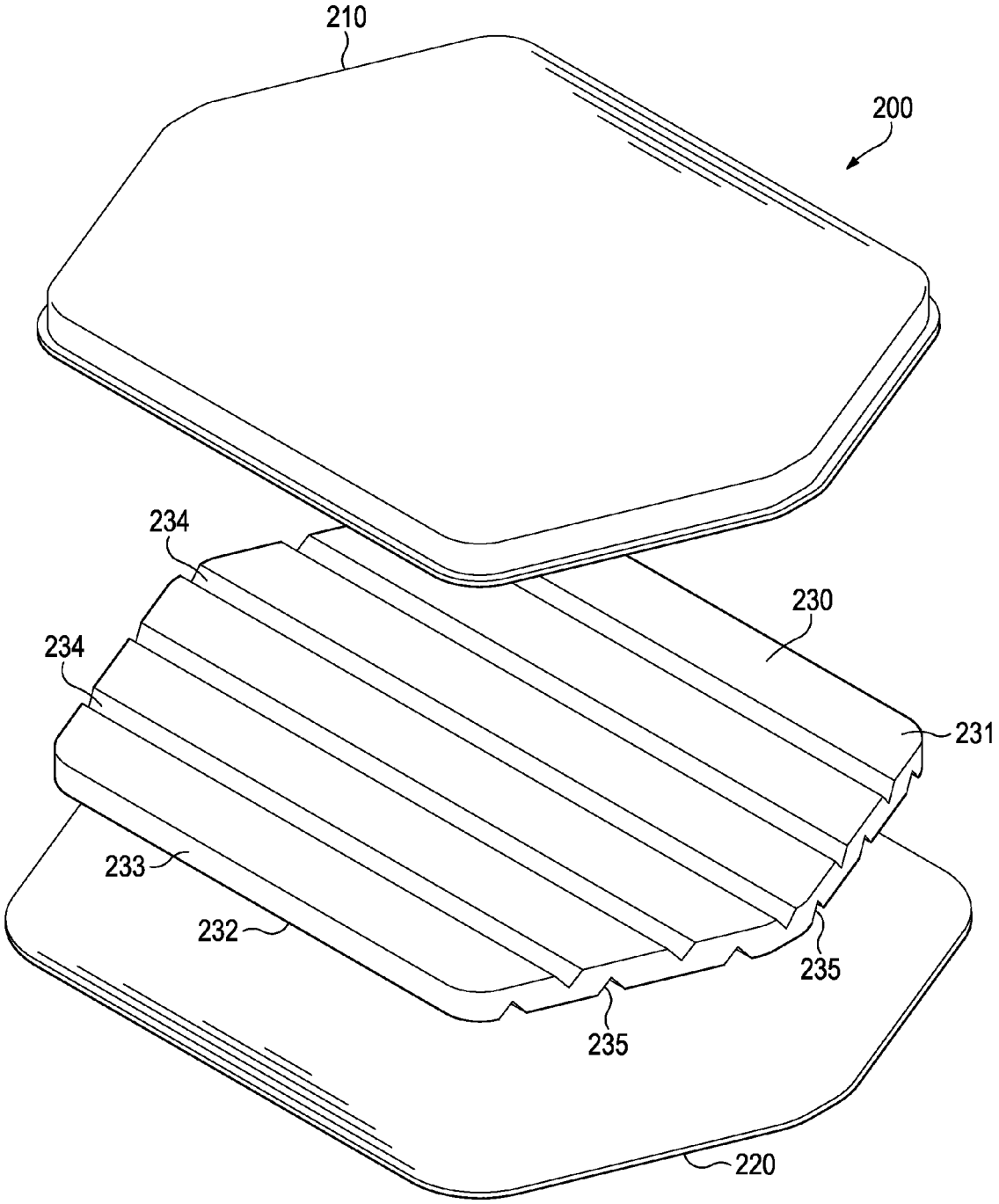
FIG. 7 is an exploded perspective view of the cushioning element.
Figure 8:
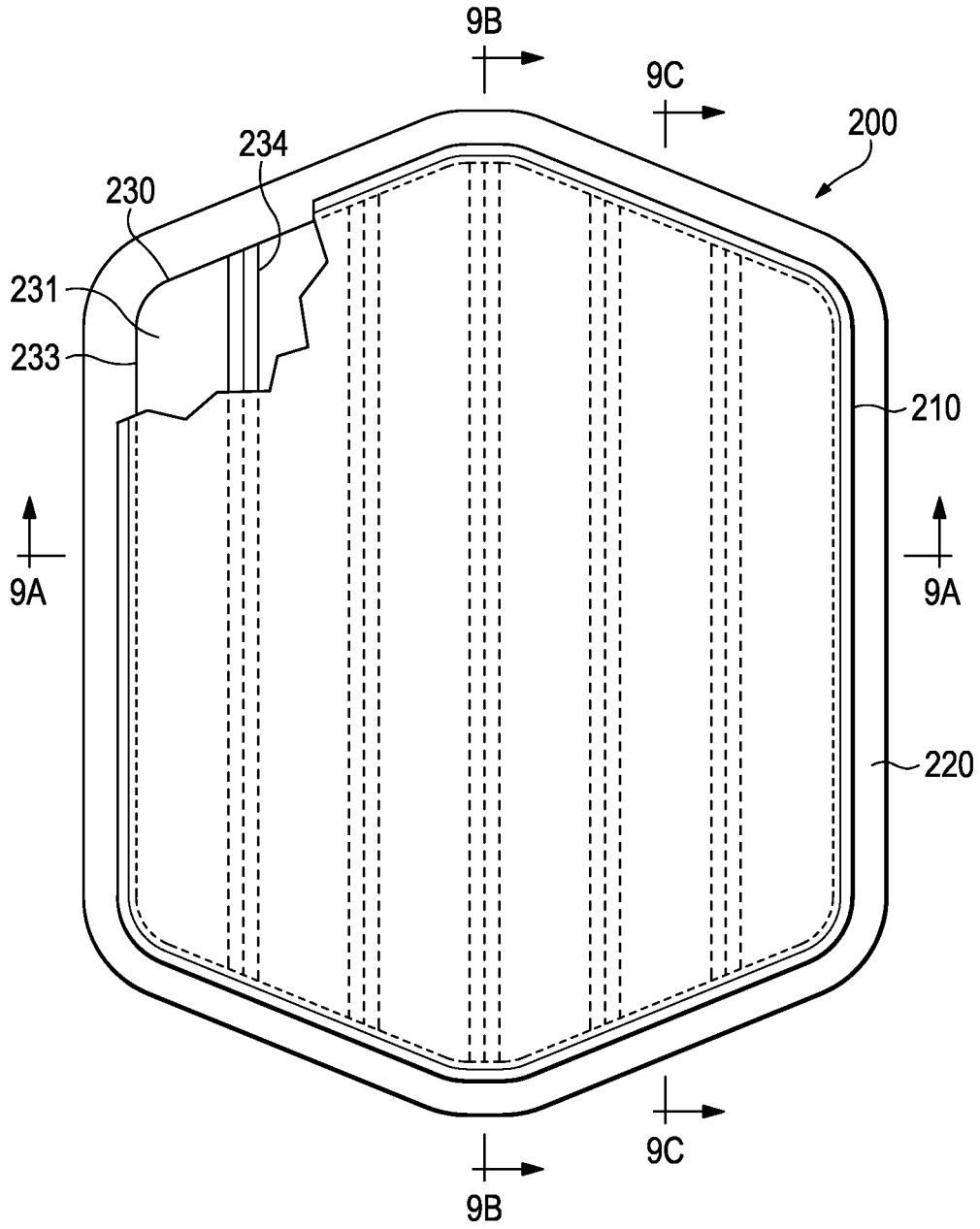
FIG. 8 is a top plan view of the cushioning element.
Figure 9A:
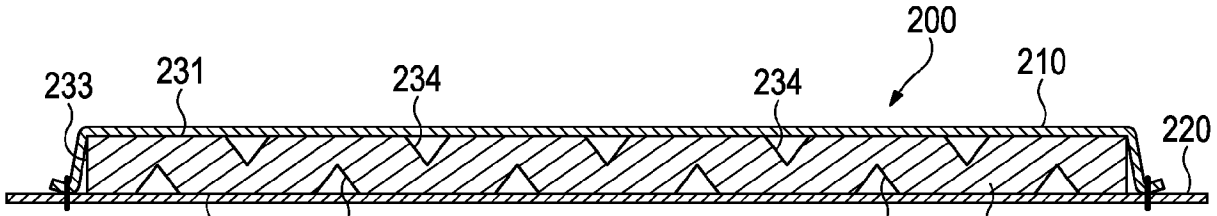
FIGS. 9A-9C are cross-sectional views of the cushioning element, as defined by section lines 9A-9C in FIG. 8.
Figure 9B:
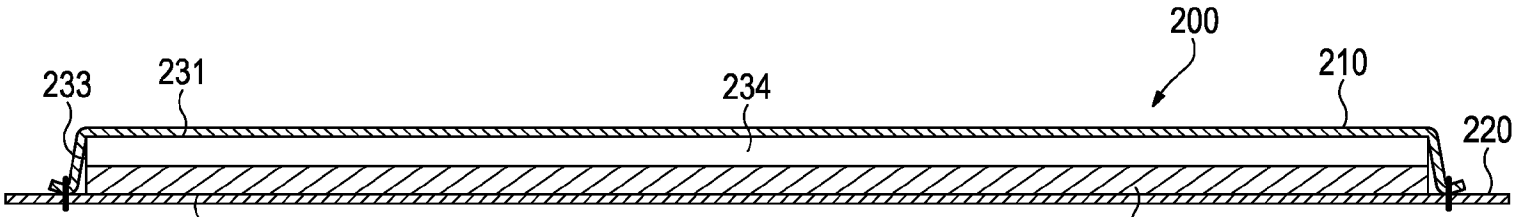
Figure 9C:
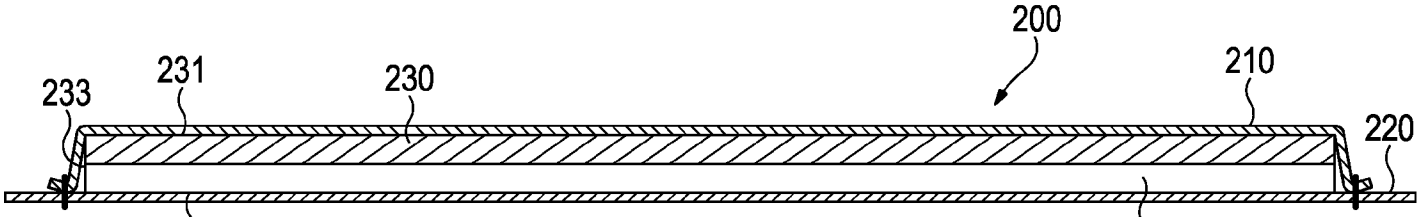

With reference to FIG. 1, a wearer or individual 10 is depicted as wearing an article of apparel 100 with the general configuration of a pair of shorts. Although apparel 100 may be worn under other articles of apparel, apparel 100 may be worn alone, may be exposed, or may be worn over other articles of apparel. Apparel 100 may also be worn in combination with other pieces of equipment (e.g., athletic or protective equipment). Although apparel 100 may be loose-fitting, apparel 100 is depicted as having a relatively tight fit of a compression garment. Accordingly, the configuration of apparel 100 and the manner in which apparel 100 is worn by individual 10 may vary significantly.

Apparel 100 is depicted individually in FIGS. 2-5 as including a pelvic region 101 and a pair of leg regions 102 that extend outward from pelvic region 101. Pelvic region 101 corresponds with a pelvic area of individual 10 and covers at least a portion of the pelvic area when worn. An upper area of pelvic region 101 defines a waist opening 103 that extends around a waist of individual 10 when apparel 100 is worn. Leg regions 102 correspond with a right leg and a left leg of individual 10 and cover at least a portion of the right leg and the left leg when worn. Lower areas of leg regions 102 each define a thigh opening 104 that extends around a thigh of individual 10 when apparel 100 is worn. Additionally, apparel 100 includes an exterior surface 105 that faces away from individual 10 when apparel 100 is worn, and apparel 100 includes an opposite interior surface 106 that faces toward individual 10 and may contact individual 10 when apparel 100 is worn.

A plurality of cushioning elements 200 are incorporated into various areas of apparel 100 to impart padding, cushioning, or otherwise attenuate impact forces. When apparel 100 is worn during athletic activities, for example, cushioning elements 200 may protect individual 10 from contact with other athletes, equipment, or the ground. With regard to apparel 100, cushioning elements 200 are located in both of pelvic region 101 and leg regions 102 and are positioned, more specifically, to protect the hips, thighs, and tailbone of individual 10. As described in greater detail below, cushioning elements 200 may be incorporated into a variety of different articles of apparel, and cushioning elements 200 may be positioned in various areas of the articles of apparel to protect specific portions (e.g., muscles, bones, joints, impact areas) of individual 10. Additionally, the shapes, sizes, and other properties of cushioning elements 200, as well as the materials and components utilized in cushioning elements 200, may vary significantly to provide a particular level of protection to the specific portions of individual 10.

Cushioning Element Configuration

An example configuration for cushioning element 200 is depicted in FIGS. 6-9B as having a generally elongate shape with pointed end areas, which is the shape depicted as being incorporated into apparel 100. Cushioning element 200 includes a first material layer 210, a second material layer 220, and a plurality of pad component 230. First material layer 210 and second material layer 220 cooperatively form an outer surface or covering for cushioning element 200. That is, first material layer 210 and second material layer 220 cooperatively form a pocket or void, in which pad component 230 is located. Whereas second material layer 220 is depicted as having a generally planar configuration, first material layer 210 extends over pad component 230 and also along sides of pad component 230 to join with second material layer 220 (e.g., through stitching, adhesive bonding, or thermal bonding). Although cushioning element 200 may be incorporated into apparel 100 in a variety of ways, first material layer 210 may be positioned exterior of second material element 220, such that cushioning element 200 protrudes outward from apparel 100. Alternately, second material layer 220 may be positioned exterior of first material element 210, such that cushioning element 200 protrudes inwardly.

Whereas first material layer 210 has a shape that covers pad component 230 and extends alongside surface 233, second material layer 220 may have a larger size that forms additional portions of apparel 100. For example, second material layer 220 may extend into both pelvic region 101 and one of leg regions 102. That is, second material layer 220 may form one surface of cushioning element 200 and extend to other areas apparel 100 to form a covering for individual 10. In this configuration, first material layer 210 forms a portion of exterior surface 105, whereas second material layer 220 forms a portion of both exterior surface 105 and interior surface 106. More particularly, a portion of second material layer 220 that is secured to pad component 230 is located inward of first material layer 210 and forms a portion of interior surface 106. Another portion of second material layer 220 that is spaced from pad component 230 forms a portion of exterior surface 105, as well as interior surface 106. As such, second material layer 220 forms both a portion of a covering for pad component 230 and other portions of apparel 100.

A variety of materials may be utilized for first material layer 210 and second material layer 220, including various textiles, polymer sheets, leather, or synthetic leather, for example. Combinations of these materials (e.g., a polymer sheet bonded to a textile) may also be utilized for each of material layers 210 and 220. Although material layers 210 and 220 may be formed from the same material, each of material layers 210 and 220 may also be formed from different materials. With regard to textiles, material layers 210 and 220 may be formed from knitted, woven, non-woven, spacer, or mesh textile components that include rayon, nylon, polyester, polyacrylic, elastane, cotton, wool, or silk, for example. Moreover, the textiles may be non-stretch, may exhibit stretch in one direction, or may exhibit multi-directional stretch. Accordingly, a variety of materials are suitable for first material layer 210 and second material layer 220.

Pad component 230 is located between and secured to each of material layers 210 and 220. More particularly, pad component 230 has a first surface 231 secured to first material layer 210, an opposite second surface 232 secured to second material layer 220, and a side surface 233 that extends between surfaces 231 and 232. First surface 231 defines a plurality of first grooves 234 that extend throughout a length of pad component 230 and toward second surface 232. Similarly, second surface 232 defines a plurality of second grooves 235 that extend throughout the length of pad component 230 and toward first surface 231. First grooves 234 are generally parallel to second grooves 235. Additionally, grooves 234 and 235 are offset from each other. That is, first grooves 234 are located in areas of pad component 230 that are between areas where second grooves 235 are located. Moreover, each of grooves 234 and 235 are depicted as having a triangular, V-shaped, angled, or pointed configuration. Although pad component 230 is secured to material layers 210 and 220, one or both of surfaces 231 and 232 may also be unsecured to material layers 210 and 220. In either configuration, surfaces 231 and 232 generally face toward material layers 210 and 220.

Although features of pad component 230 and grooves 234 and 235 may vary considerably, as discussed in greater detail below, some examples of suitable configurations are discussed here. For example, pad component 230 may have a thickness (i.e., distance between surfaces 231 and 232) of ten millimeters. Given this thickness, grooves 234 and 235 may have a width of five millimeters and a depth of five millimeters. As such, grooves 234 and 235 may extend through approximately fifty percent of a thickness of pad component 230. Moreover, grooves 234 and 235 may be spaced by twenty millimeters. An advantage to the various dimensions discussed above relates to imparting a suitable degree flex, stretch, and breathability to cushioning element 200, as discussed below. These dimensions and percentages, however, are intended to merely be examples, and the dimensions and percentages may vary considerably from the specific numbers identified above.

A variety of materials may be utilized for pad component 230, including various polymer foam materials that return to an original shape after being compressed. Examples of suitable polymer foam materials for pad component 230 include polyurethane, ethylvinylacetate, polyester, polypropylene, and polyethylene foams. Moreover, both thermoplastic and thermoset polymer foam materials may be utilized. In some configurations of cushioning element 200, pad component 230 may be formed from a polymer foam material with a varying density, or solid polymer or rubber materials may be utilized. Fluid-filled chambers may also be utilized as pad component 230. Also, different pad component 230 may be formed from different materials, or may be formed from similar materials with different densities. As discussed in greater detail below, the polymer foam materials forming pad component 230 attenuate impact forces to provide cushioning or protection. By selecting thicknesses, materials, and densities for each of the various pad component 230, the degree of impact force attenuation may be varied throughout apparel 100 to impart a desired degree of cushioning or protection.

The compressible polymer foam materials forming pad component 230 attenuate impact forces that compress or otherwise contact cushioning element 200. When incorporated into apparel 100 or another article of apparel, for example, the polymer foam materials of pad component 230 may compress to protect a wearer from contact with other athletes, equipment, or the ground. Accordingly, cushioning element 200 may be utilized to provide cushioning or protection to areas of individual 10 or other wearers that are covered by cushioning element 200.

Figure 10A:
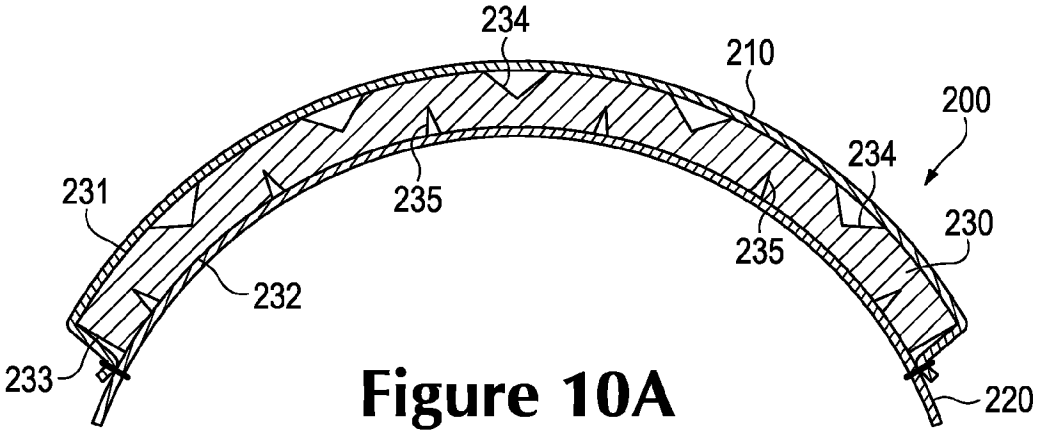
FIG. 10A is a cross-sectional view corresponding with FIG. 9A and depicting the cushioning element in a flexed configuration.
Figure 10B:
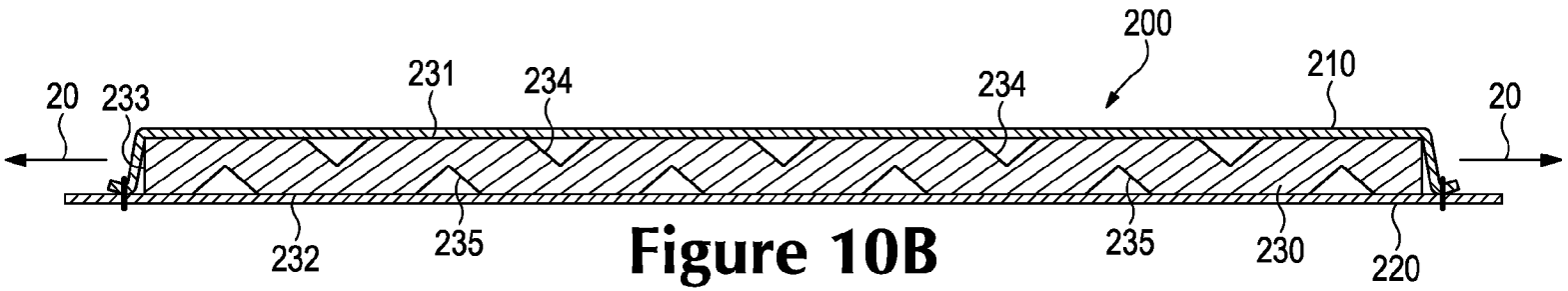
FIG. 10B is a cross-sectional view corresponding with FIG. 9A and depicting the cushioning element in a stretched configuration.
Figure 10C:
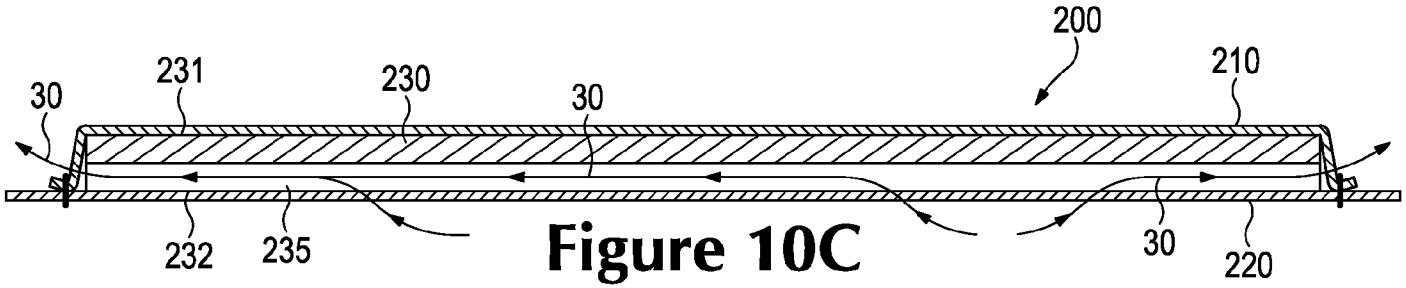
FIG. 10C is a cross-sectional view corresponding with FIG. 9C and depicting breathability of the cushioning element.

In addition to attenuating impact forces, cushioning element 200 has an advantage of simultaneously providing one or more of flex, stretch, breathability, relatively low overall mass, and launderability. Referring to FIG. 10A, cushioning element 200 is depicted as being flexed. In this configuration, first grooves 234 effectively expand and second grooves 235 effectively collapse to impart flexibility. Referring to FIG. 10B, cushioning element 200 is depicted as being stretched by a force 20. In this configuration, the offset structure of grooves 234 and 235 permits pad component 230 to flatten or otherwise elongate due to the effects of force 20. An advantage to flex and stretch is that cushioning element 200 may better conform with contours of individual 10, and cushioning element 200 may expand, collapse, flatten, and elongate to facilitate movements of individual 10, while still conforming with the contours of individual 10 during the movements. Additionally, individual 10 may generate excess heat and perspire when wearing apparel 100 and engaging in athletic activities. Referring to FIG. 10C, the breathability of cushioning element 200 is depicted by various paths 30, along which heat and moisture may pass to exit cushioning element 200. The heat and moisture from individual 10 may, therefore, (a) pass through second material layer 220, (b) enter one of second grooves 235, (c) move to end areas of second groove 235, and (d) pass through first material layer 210, thereby exiting apparel 100. Furthermore, the materials and structure discussed above for cushioning element 200 (a) imparts a relatively low overall mass that does not add significant weight to individual 10 during the athletic activities and (b) permits laundering without significant shrinkage or warping, even when temperatures associated with commercial laundering processes are utilized. Accordingly, cushioning element 200 may simultaneously provide impact force attenuation, flex, stretch, breathability, relatively low overall mass, and launderability.

Manufacturing Process

Figure 11:
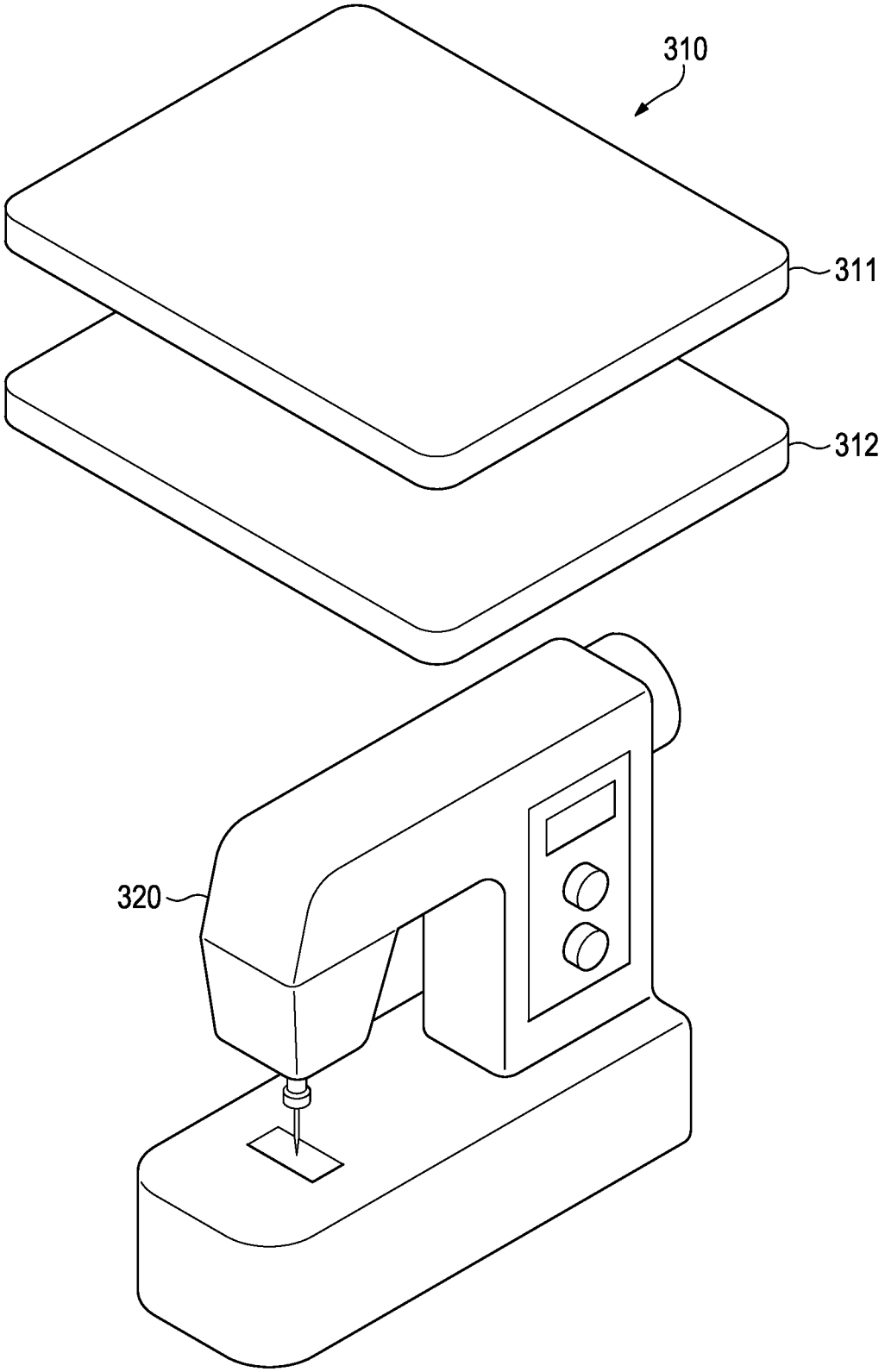
FIG. 11 is a perspective view of portions of a manufacturing apparatus utilized in a manufacturing process for the cushioning element.

A variety of techniques may be utilized to manufacture cushioning element 200. With reference to FIG. 11, a manufacturing apparatus 300 is disclosed as including a press 310 and a sewing machine 320. Other elements, such as a mold, router, die cutter, or laser may also be utilized, but are not depicted here. A variety of other manufacturing apparatuses that operate in a similar manner may also be utilized. Accordingly, manufacturing apparatus 300 is only intended to provide an example of a manufacturing apparatus for the production of cushioning element 200.

Initially, the various components of cushioning element 200 are cut, shaped, or otherwise prepared. For example, material layers 210 and 220 may be cut to a particular shape using die cutting, laser cutting, or hand cutting processes. Whereas first material layer 210 has a shape that covers pad component 230 and extends alongside surface 233, second material layer 220 may have a larger size that forms additional portions of apparel 100. For example, second material layer 220 may extend into both pelvic region 101 and one of leg regions 102. That is, second material layer 220 may form one surface of cushioning element 200 and extend to other areas apparel 100 to form a covering for individual 10. Various processes may also be utilized to form pad component 230. For example, polymer resin with a blowing agent may be located in a mold having the shape of pad component 230. An advantage to this process is that a single process may be used to form the polymer foam material of pad component 230, as well as the various grooves 234 and 235. As another example, a preformed layer of polymer foam may be obtained, and a router may be used to form grooves 234 and 235. In other processes, grooves 234 and 235 may be formed from a heated element that presses into a preformed layer of polymer foam, or a computer-controlled machine tool may be utilized. As yet further examples, a three dimensional printer may be utilized to form pad component 230, or a polymer foam element having grooves 234 and 235 may be extruded and then cut to the shape of pad component 230.

Figure 12A:
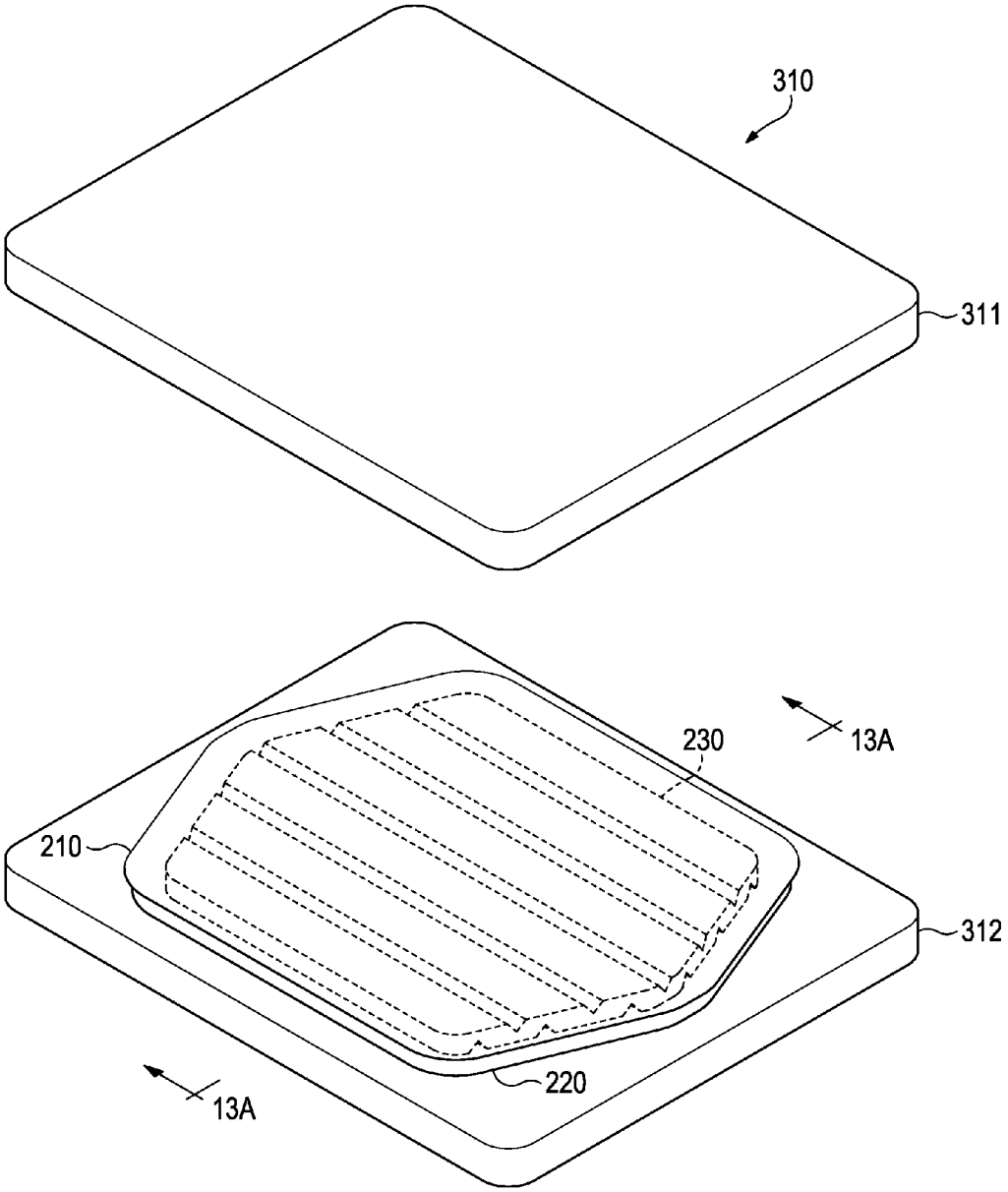
FIGS. 12A-12D are schematic perspective views of the manufacturing process.
Figure 12B:
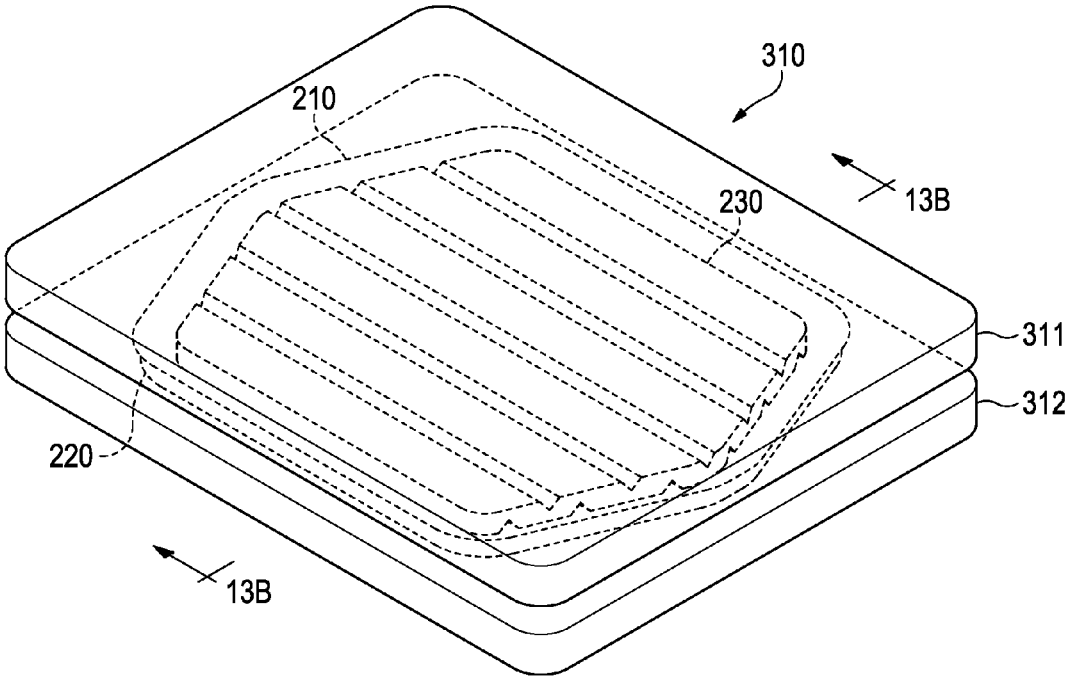
Figure 13A:
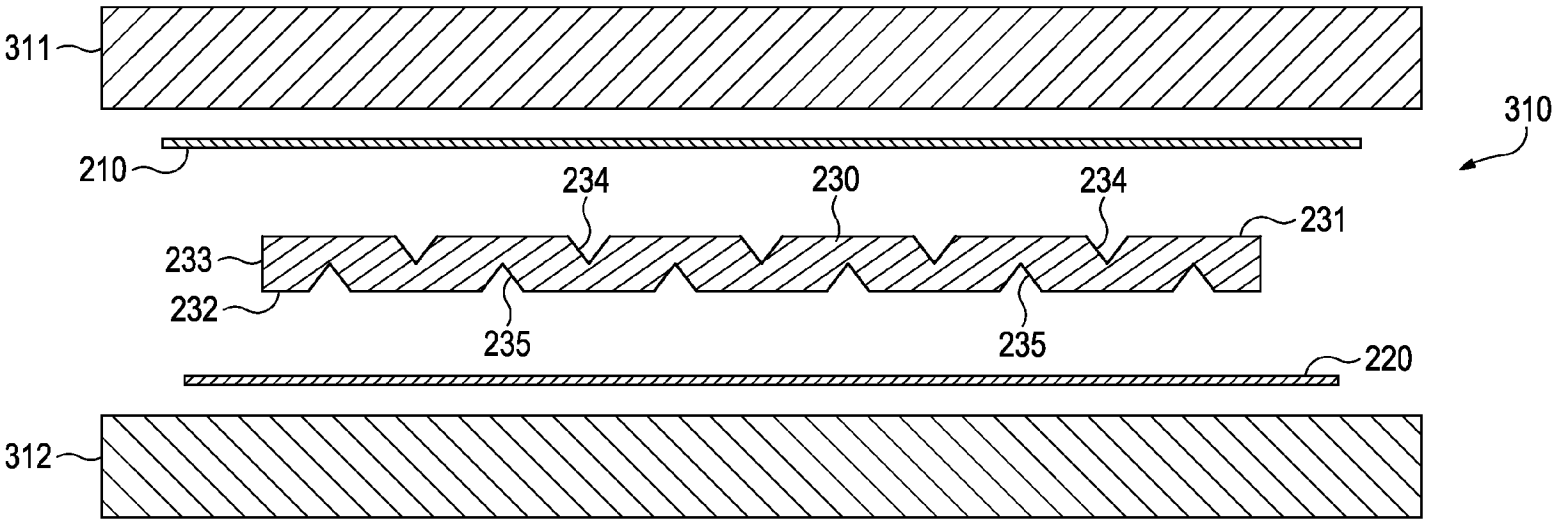
FIGS. 13A-13D are schematic cross-sectional views of the manufacturing process, as respectively defined by section lines 13A-13D in FIGS. 12A-12D.
Figure 13B:
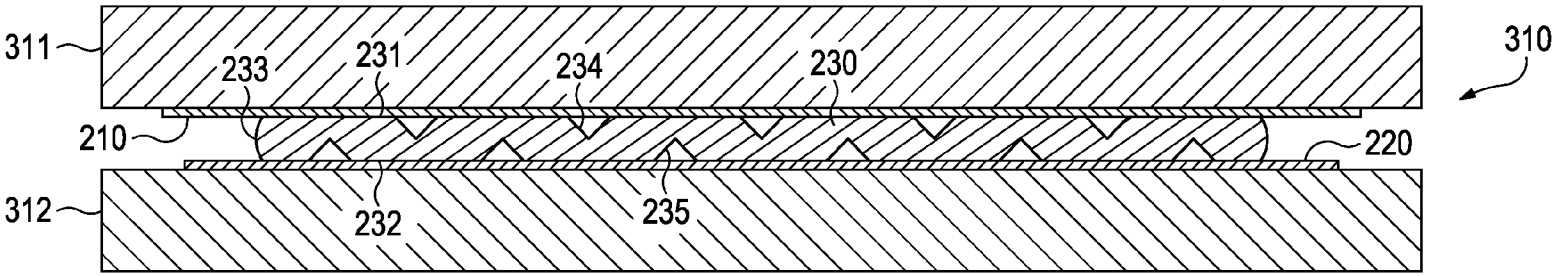

Once the various components of cushioning element 200 are cut, shaped, or otherwise prepared, the components may be placed between two platens 311 and 312 of press 310, as depicted in FIGS. 12A and 13A. More particularly, first material layer 210 may be located adjacent to platen 311, second material layer 220 may be located adjacent to platen 312, and pad component 230 may be located between layers 210 and 220. Following proper positioning, platens 311 and 312 close upon and compress first material layer 210, second material layer 220, and pad component 230, as depicted in FIGS. 12B and 13B. More particularly, platen 311 compresses first material layer 210 against first surface 231 of pad component 230, and platen 312 compresses second material layer 220 against second surface 232 of pad component 230.

Platens 311 and 312 effectively compress pad component 230 between material layers 210 and 220 to ensure bonding. As an example, an adhesive may be utilized to bond pad component 230 to each of material layers 210 and 220. At prior stages of the manufacturing process, an adhesive may be applied to either (a) areas of material layers 210 and 220 that are intended to bond with pad components 230 or (b) surfaces 231 and 232 of pad component 230. Although the adhesive may be applied to material layers 210 and 220, an advantage of applying the adhesive to surfaces 231 and 232 is that the adhesive is absent from areas of material layers 210 and 220 that are not intended to bond with pad component 230. As another example, heat may be utilized to bond pad component 230 to each of material layers 210 and 220. In configurations where pad component 230 is formed from a thermoplastic polymer foam material, heating and melting of pad component 230 at surfaces 231 and 232 may be utilized to bond pad component 230 to each of material layers 210 and 220. Similarly, material layers 210 and 220 may also incorporate a thermoplastic polymer material, or a thermoplastic bonding agent or thermally-activated adhesive may be utilized. In order to elevate the temperatures, various radiant heaters, radio frequency emitters, or other devices may be utilized. Alternately, press 310 may be heated such that contact with platens 311 and 312 raises the temperature of pad component 230 to a level that facilitates bonding.

One consideration at this stage of the manufacturing process relates to the method by which an adhesive, thermoplastic polymer material, or a thermoplastic bonding agent is applied to the components of cushioning element 200. As noted above, an advantage of applying an adhesive to surfaces 231 and 232 is that the adhesive is absent from areas of material layers 210 and 220 that are not intended to bond with pad component 230. A similar advantage applies to a thermoplastic polymer material or thermoplastic bonding agent. Moreover, applying the adhesive, thermoplastic polymer material, or thermoplastic bonding agent to surfaces 231 and 232 prior to the formation of grooves 234 and 235 may ensure that the bonding materials are absent from grooves 234 and 235. For example, when thermoplastic polymer sheets are utilized as the bonding material, the thermoplastic polymer sheets may be bonded or secured to opposite sides of a polymer foam member (i.e., the polymer foam member that forms pad component 230). Then, grooves 234 and 235 may be formed using a router or other process, which effectively removes portions of the thermoplastic polymer sheets located at grooves 234 and 235. As such, the thermoplastic polymer sheets are absent from grooves 234 and 235 and effectively limited to the areas of surfaces 231 and 232 that bond with layers 210 and 220. Accordingly, by selecting a particular order for the manner in which components of cushioning element 200 are applied, excess materials that may form unintended bonds or detract from the aesthetic properties of cushioning element 200 may be avoided.

Figure 12C:
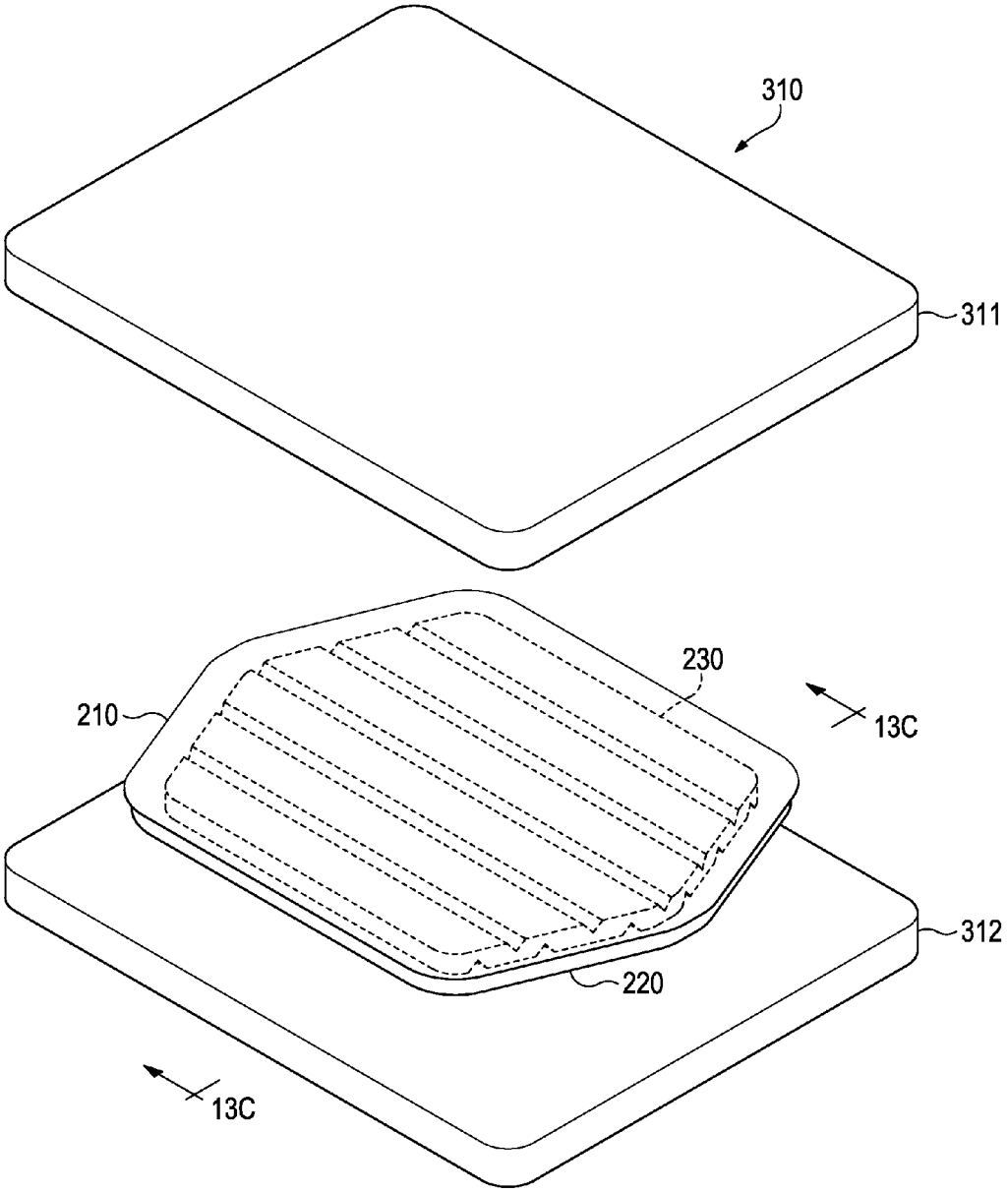
Figure 12D:
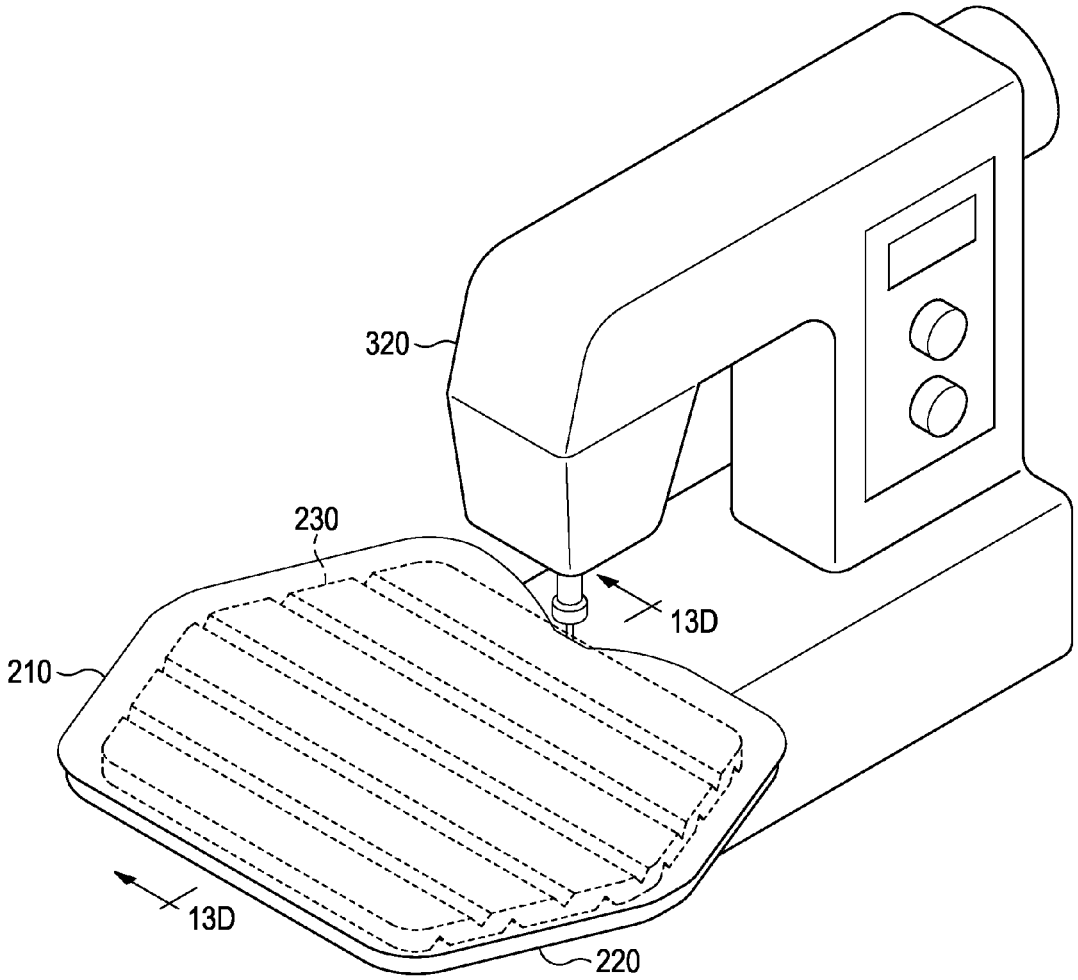
Figure 13C:
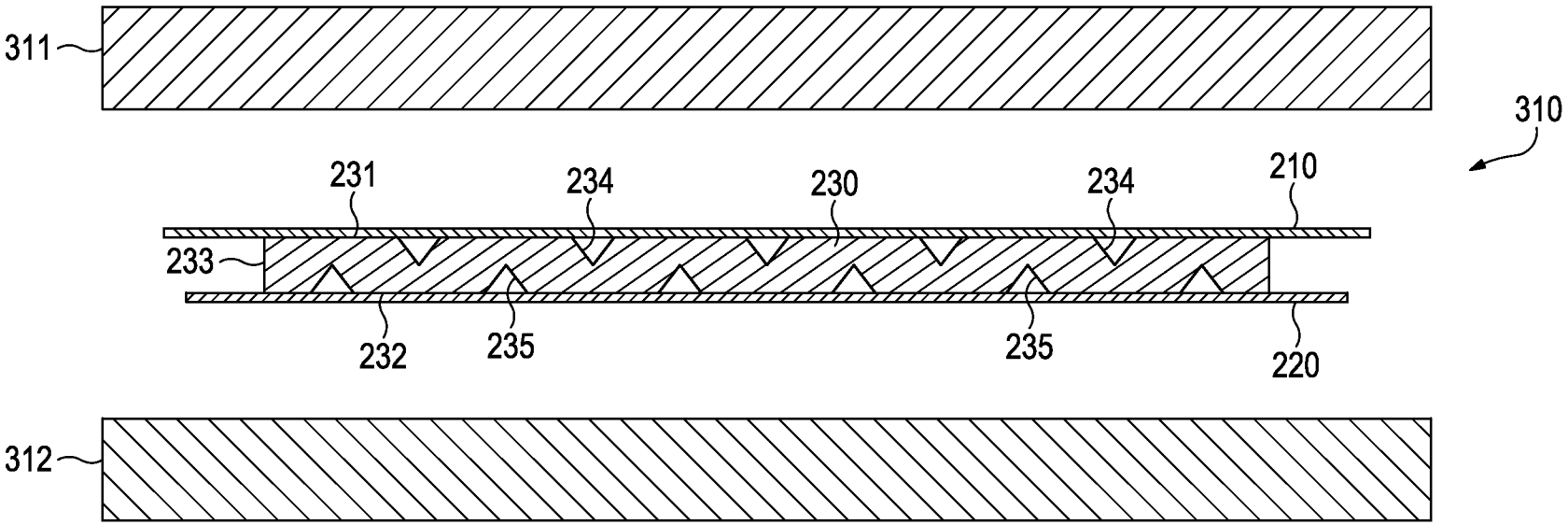
Figure 13D:
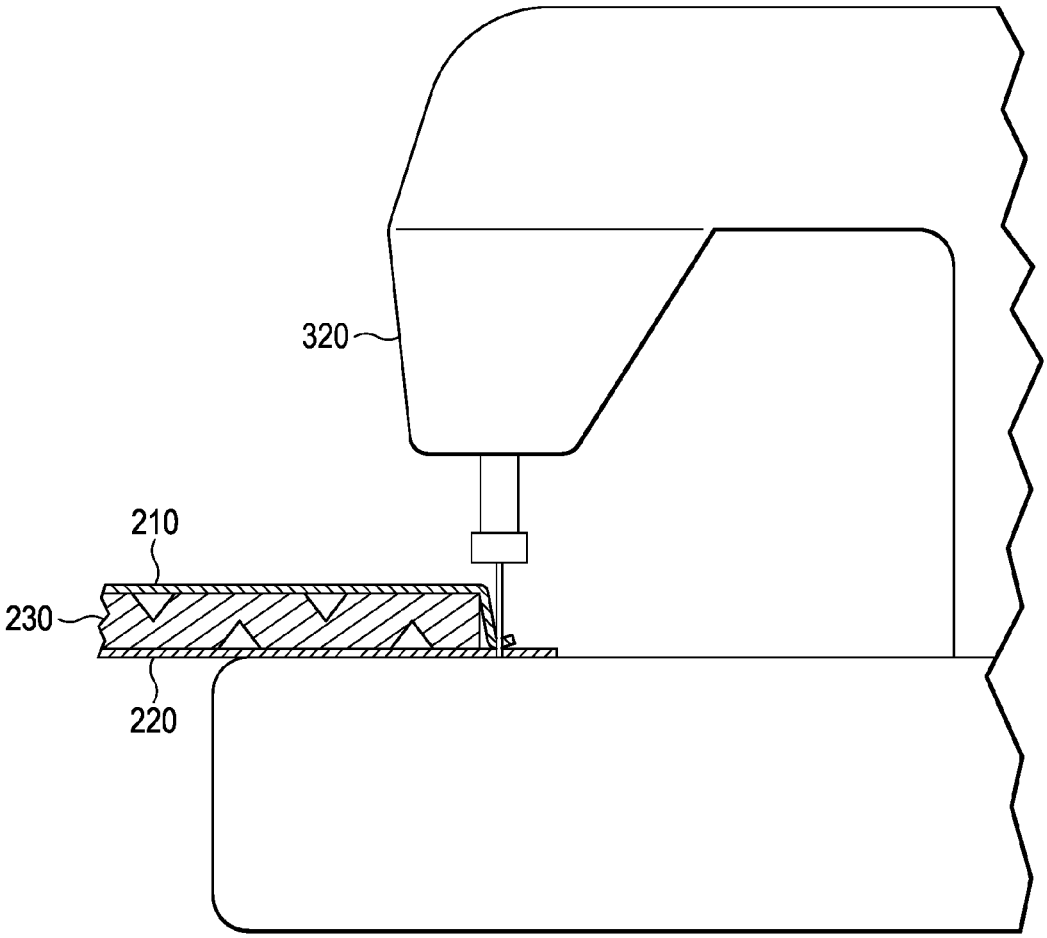

Following compression and bonding, platens 311 and 312 separate to expose the components of cushioning element 200, as depicted in FIGS. 12C and 13C. At this stage of the manufacturing process, first material layer 210 is unsecured to second material layer 220. Additional stitching, adhesive, or thermal bonding steps may now be utilized to join material layers 210 and 220 around the periphery of pad components 230. As an example, sewing machine 320 may be utilized to stitch material layers 210 and 220 together, as depicted in FIGS. 12D and 13D, thereby substantially completing the manufacture of cushioning element 200.

Further Cushioning Element Configurations

Aspects of cushioning element 200 may vary, depending upon the intended use for cushioning element 200 and the product in which cushioning element 200 is incorporated. Moreover, changes to the dimensions, shapes, and materials utilized within cushioning element 200 may vary the overall properties of cushioning element 200. That is, by changing the dimensions, shapes, and materials utilized within cushioning element 200, the compressibility, impact force attenuation, flex, stretch, breathability, and overall mass of cushioning element 200 may be tailored to specific purposes or products. A plurality of variations for cushioning element 200 are discussed below. Any of these variations, as well as combinations of these variations, may be utilized to tailor the properties of cushioning element 200 to an intended use. Moreover, any of these variations may be manufactured through the process or variations of the process discussed above.

Figure 14A:
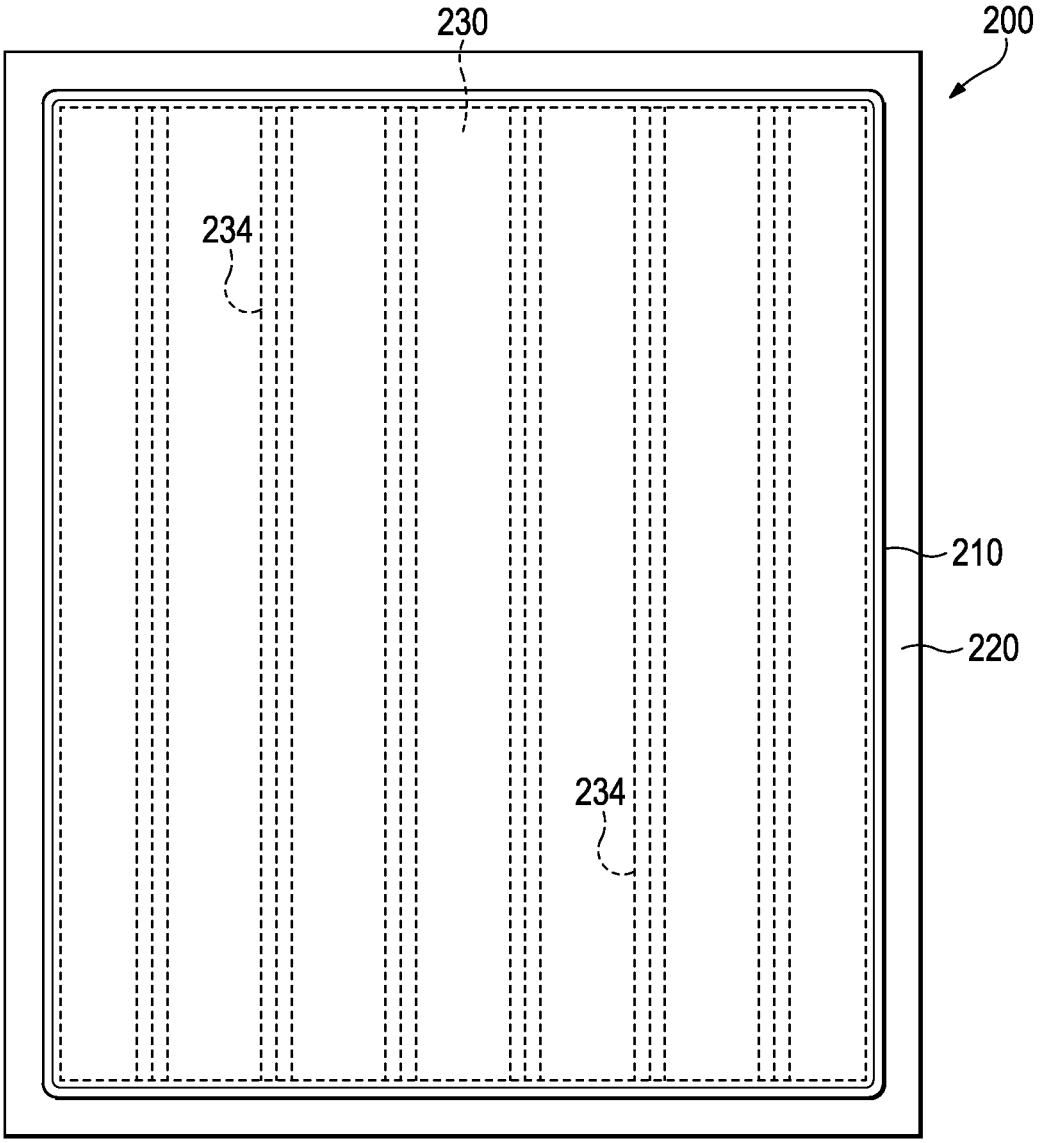
FIGS. 14A-14K are top plan views corresponding with FIG. 8 and depicting further configurations of the cushioning element.
Figure 14B:
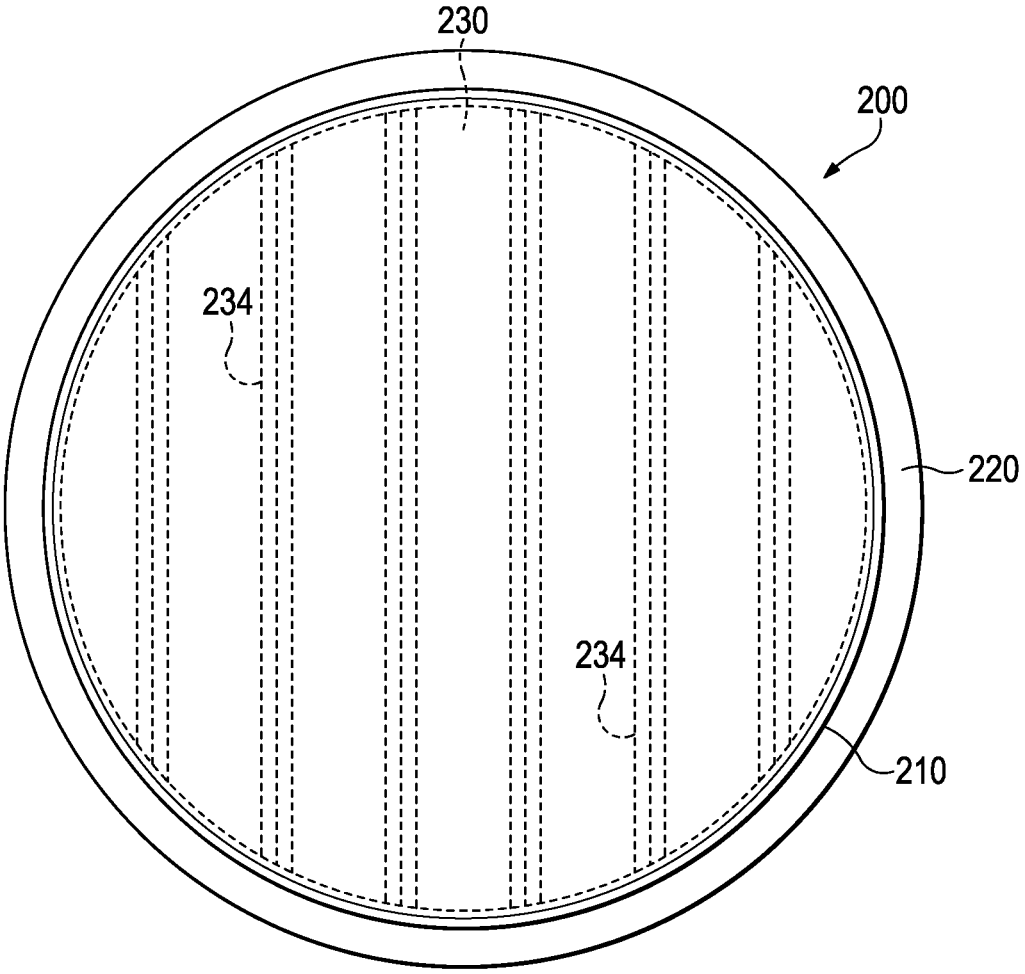
Figure 14C:
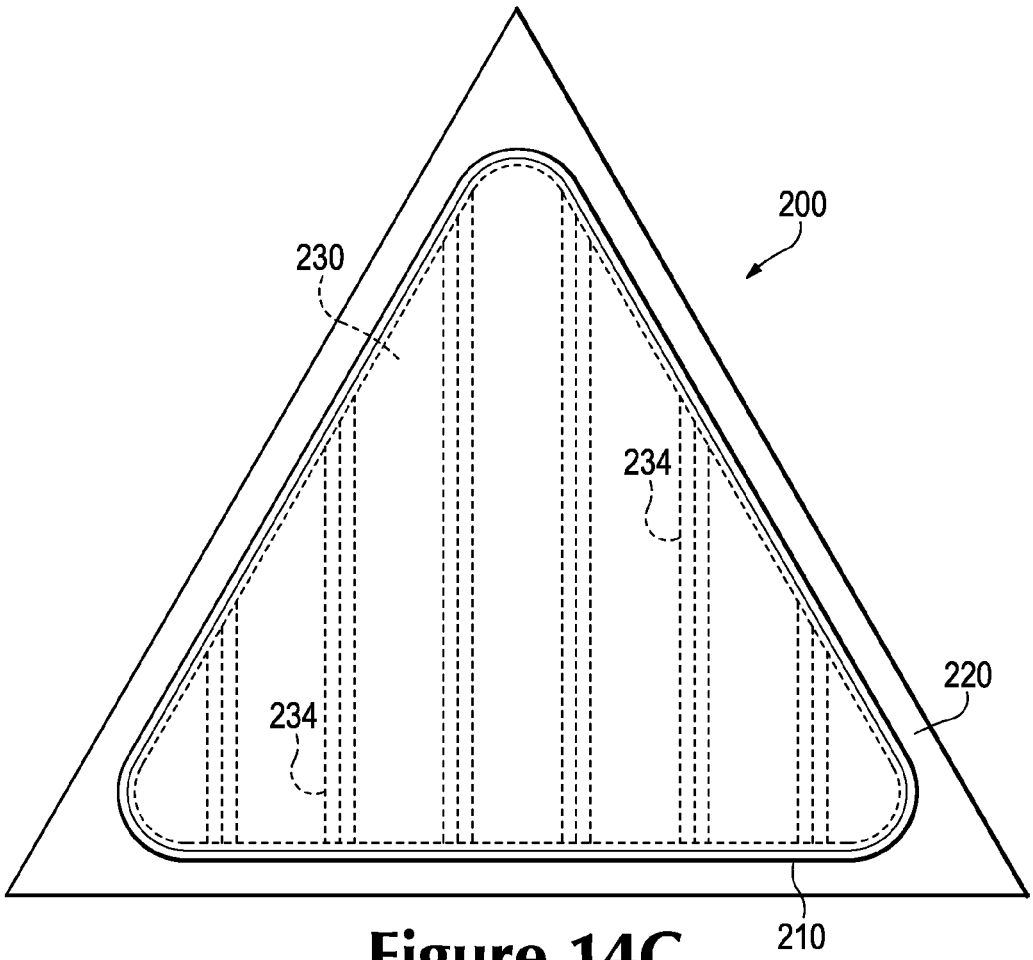
Figure 14D:
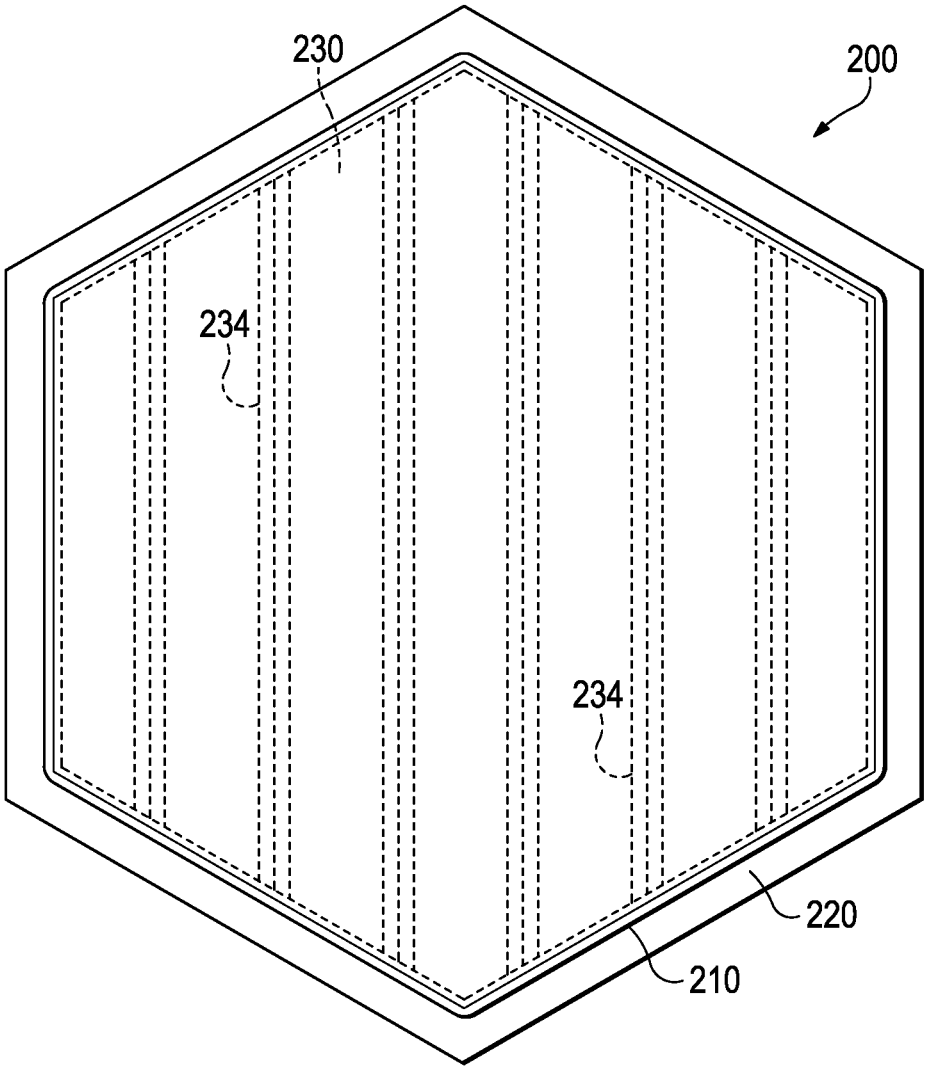
Figure 14E:
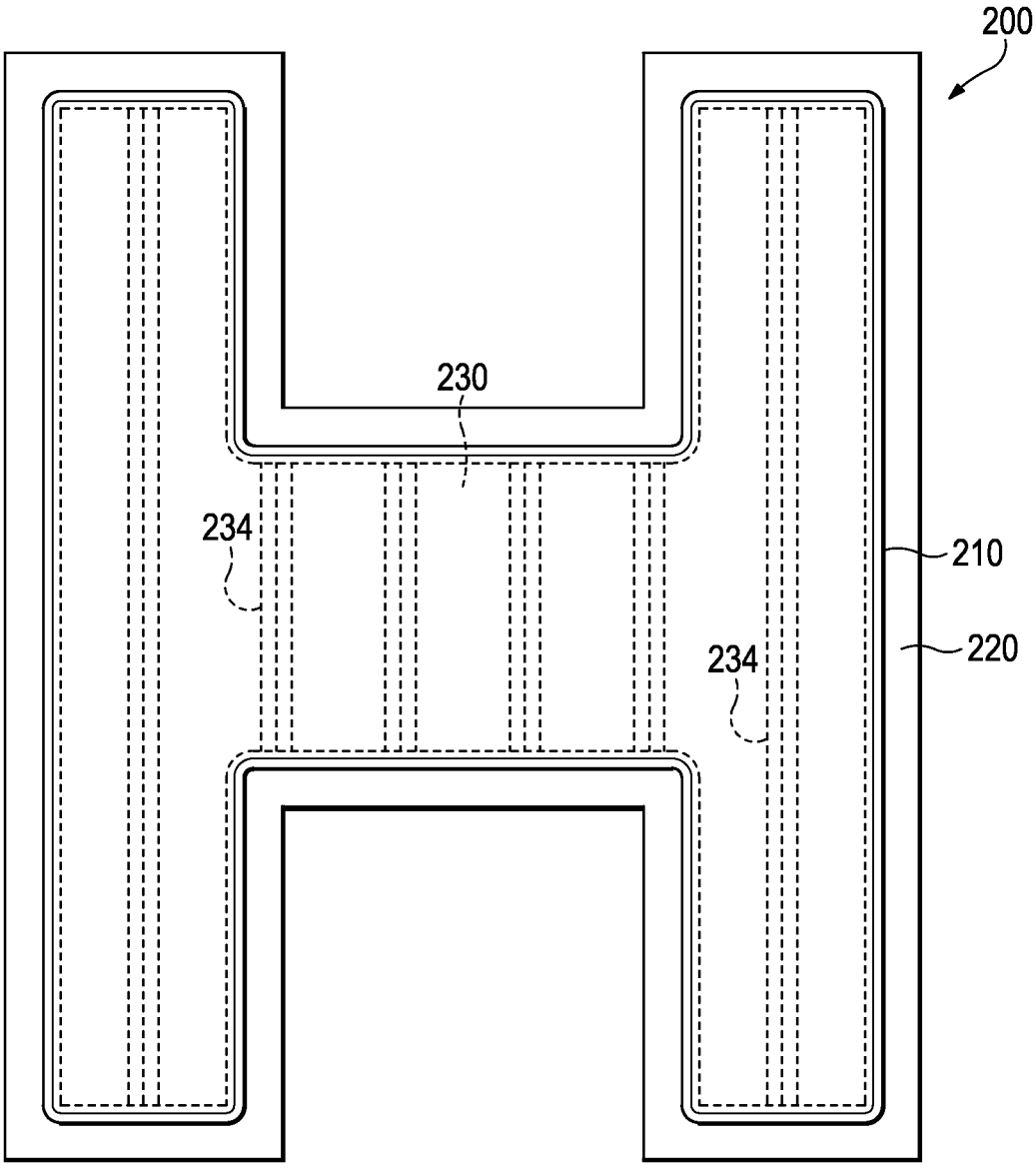
Figure 14F:
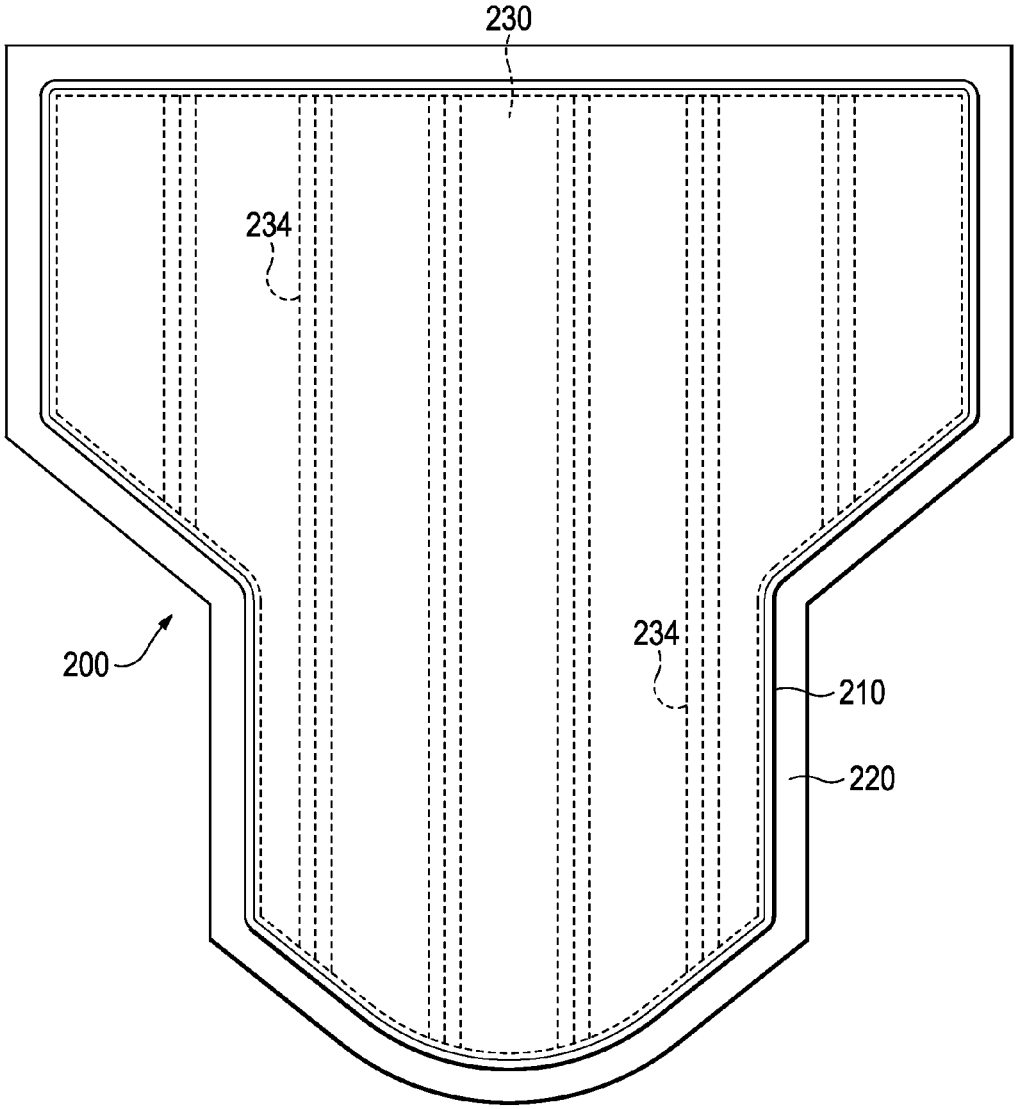
Figure 14G:
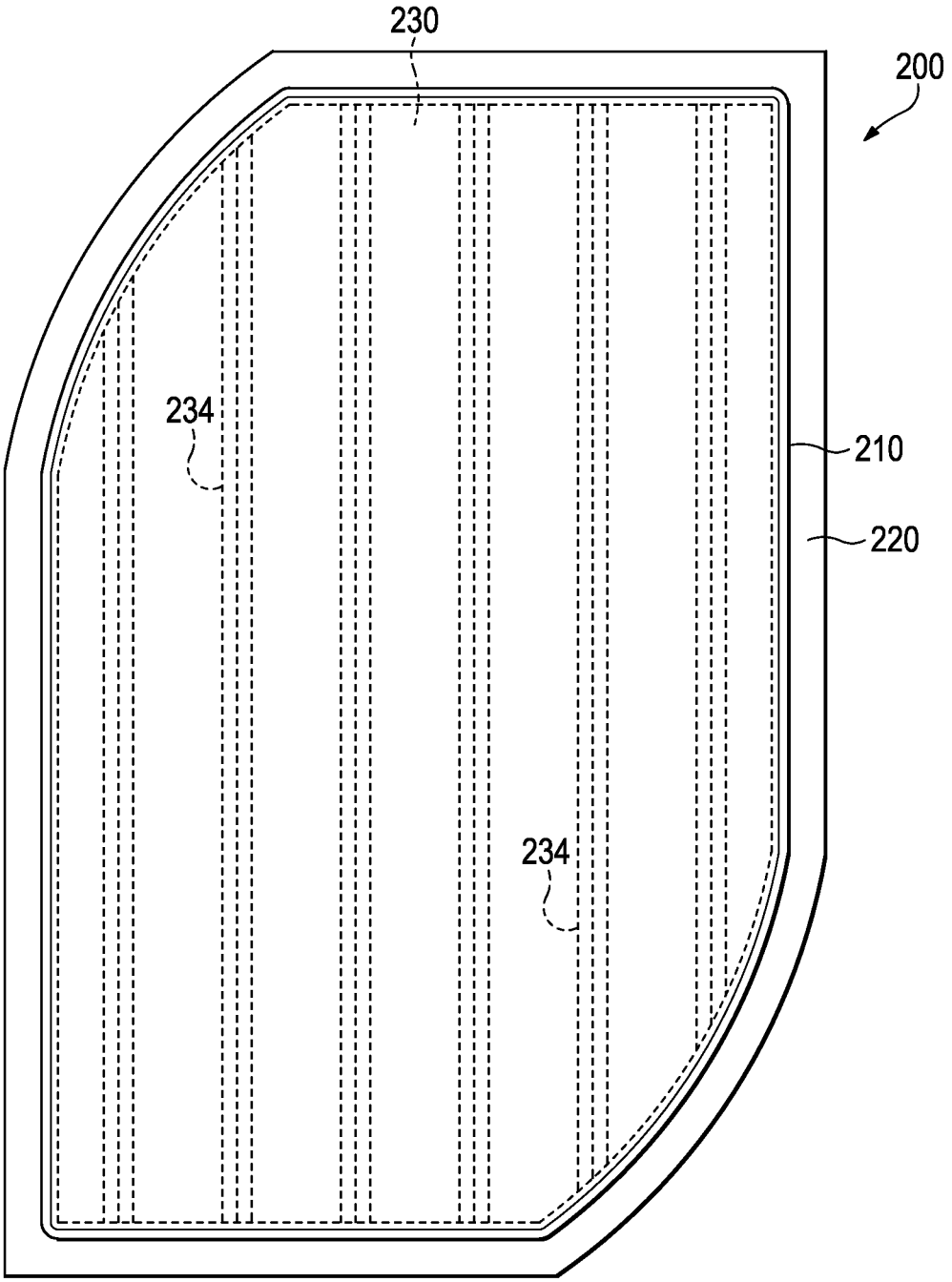
Figure 14H:
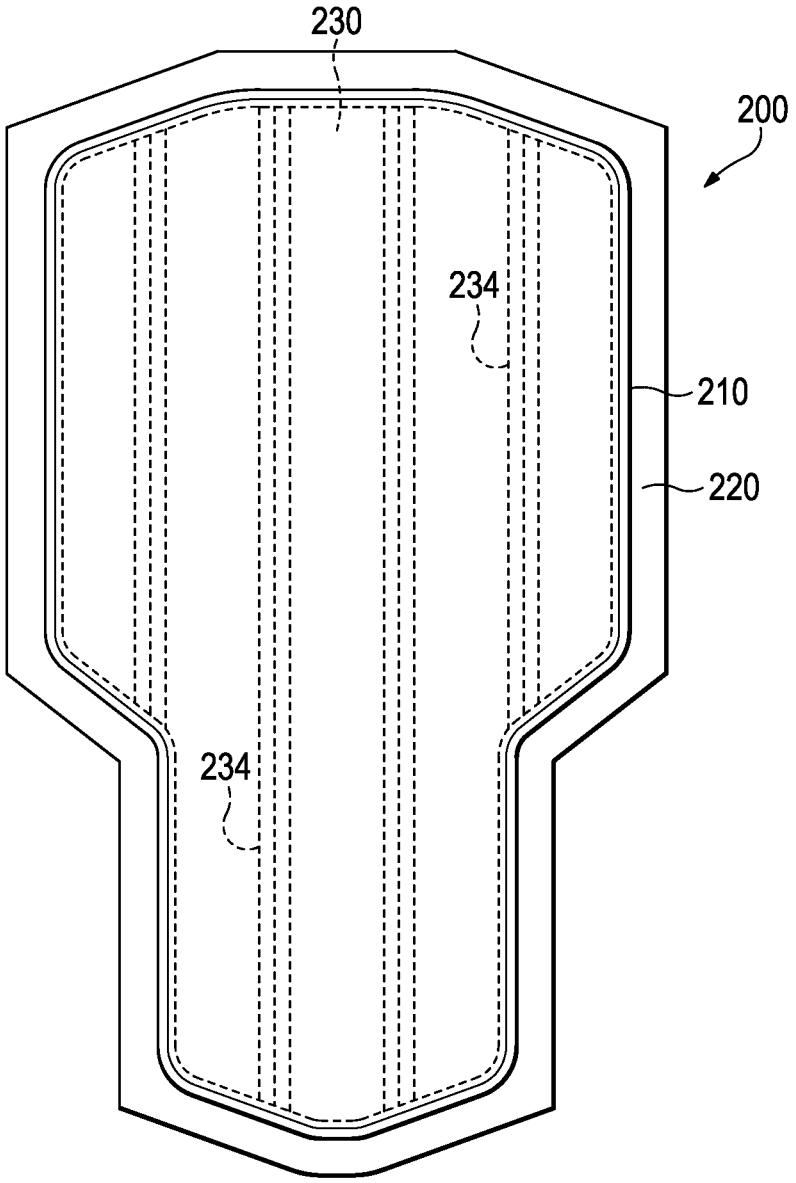
Figure 14I:
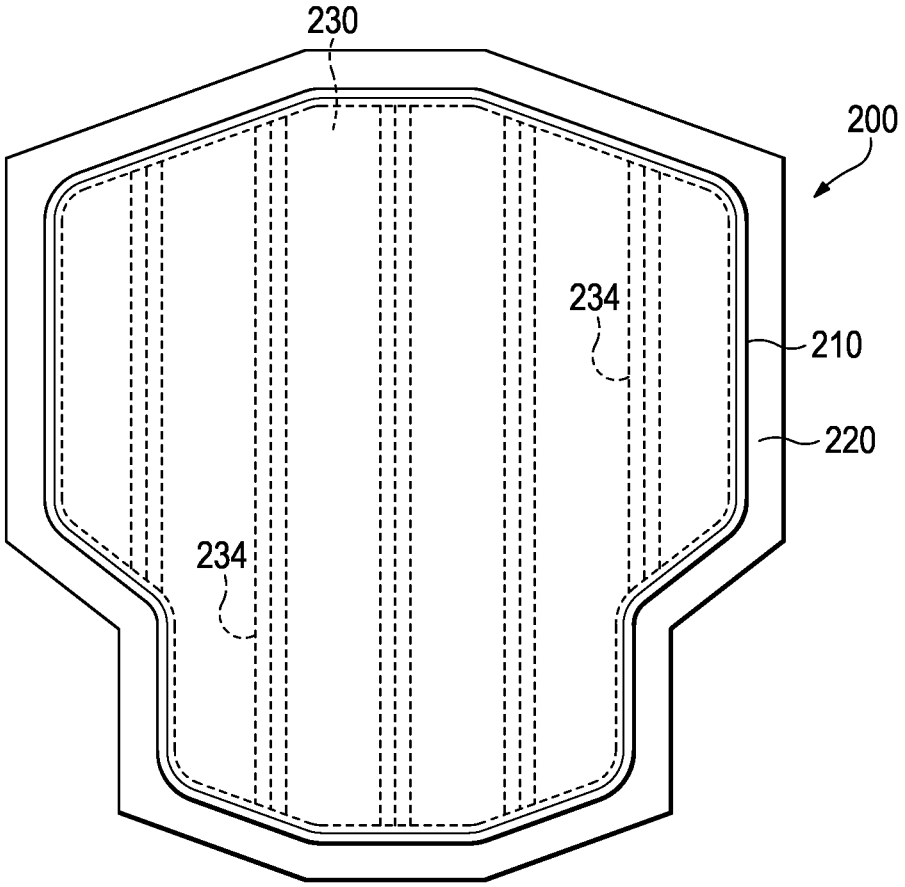

As discussed above, cushioning component 200 may have a generally elongate shape with pointed end areas. The overall shape of cushioning element 200 may, however, vary to include a variety of other shapes. Referring to FIG. 14A, cushioning element 200 exhibits a generally rectangular shape. In further configurations, cushioning element 200 may have a round, triangular, hexagonal, or H-shaped structure, as respectively depicted in FIGS. 14B-14E. Although any of these shapes may be utilized in apparel 100, various other shapes may also be utilized. As examples, FIG. 14F depicts a configuration of cushioning element 200 with a shape suitable for a hip pad, FIG. 14G depicts a configuration of cushioning element 200 with a shape suitable for a thigh pad, and FIG. 14H depicts a configuration of cushioning element 200 with a shape suitable for a tailbone pad. A configuration for cushioning element 200 that has a shape suitable for an elbow pad (e.g., for a shirt, jacket, or arm sleeve) is depicted in FIG. 14I.

Figure 14J:
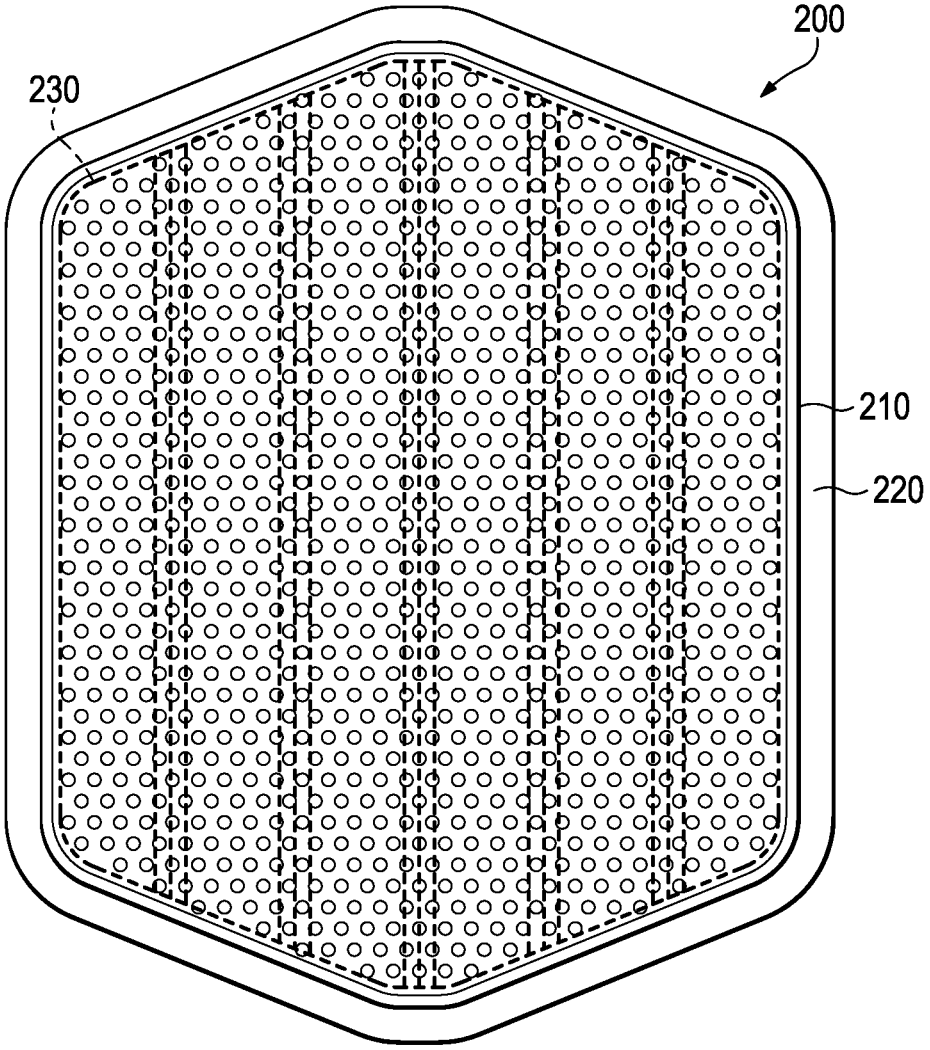
Figure 14K:
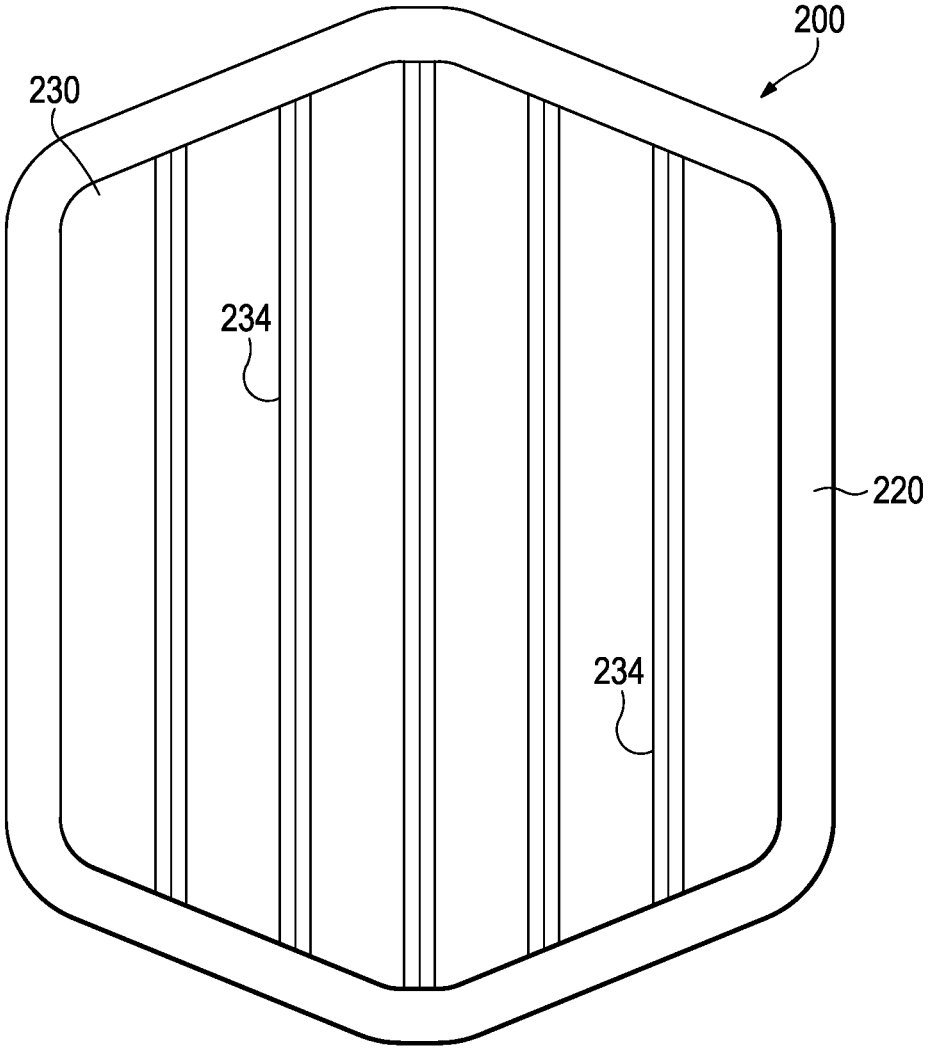

Various aspects relating to first material layer 210 and second material layer 220 may also vary significantly. As discussed above, material layers 210 and 220 may be formed from various textiles, polymer sheets, leather, synthetic leather, or combinations of materials, for example. Moreover, breathability may be enhanced when the materials are air-permeable. In general, textiles are permeable to both heat and moisture. Polymer sheets, leather, synthetic leather, or combinations of materials, however, may not exhibit significant permeability. As depicted in FIG. 14J, various perforations, holes, or apertures may be formed in one or both of material layers 210 and 220 to enhance breathability. In further configurations, as depicted in FIG. 14K, first material layer 210 may be entirely absent from cushioning element 200.

Figure 15A:
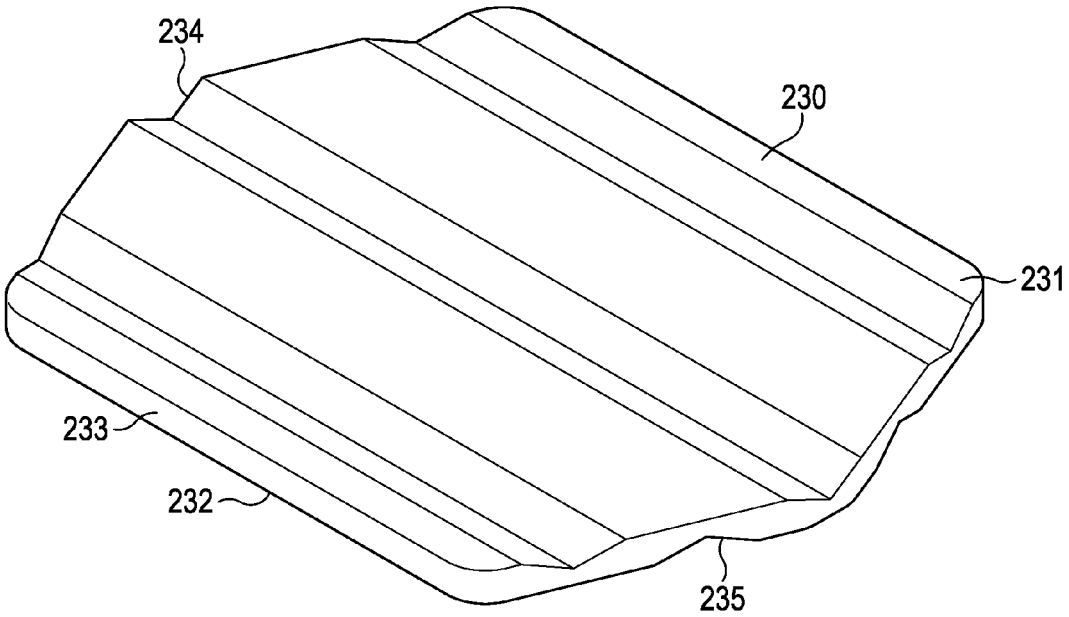
FIGS. 15A-15J are perspective views depicting further configurations of a pad component of the cushioning element.
Figure 15B:
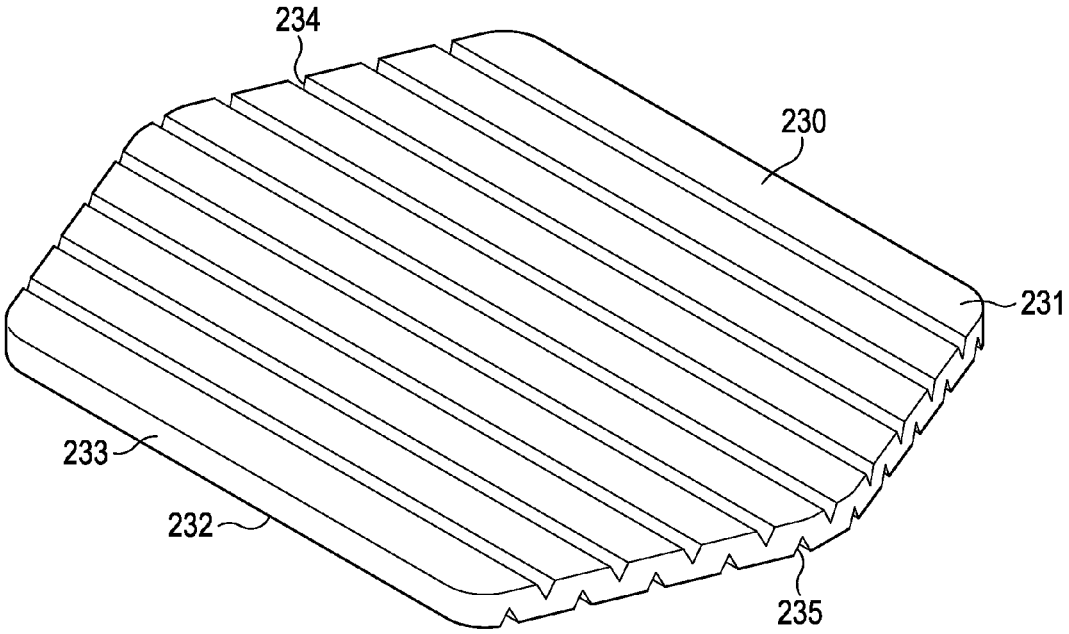
Figure 15C:
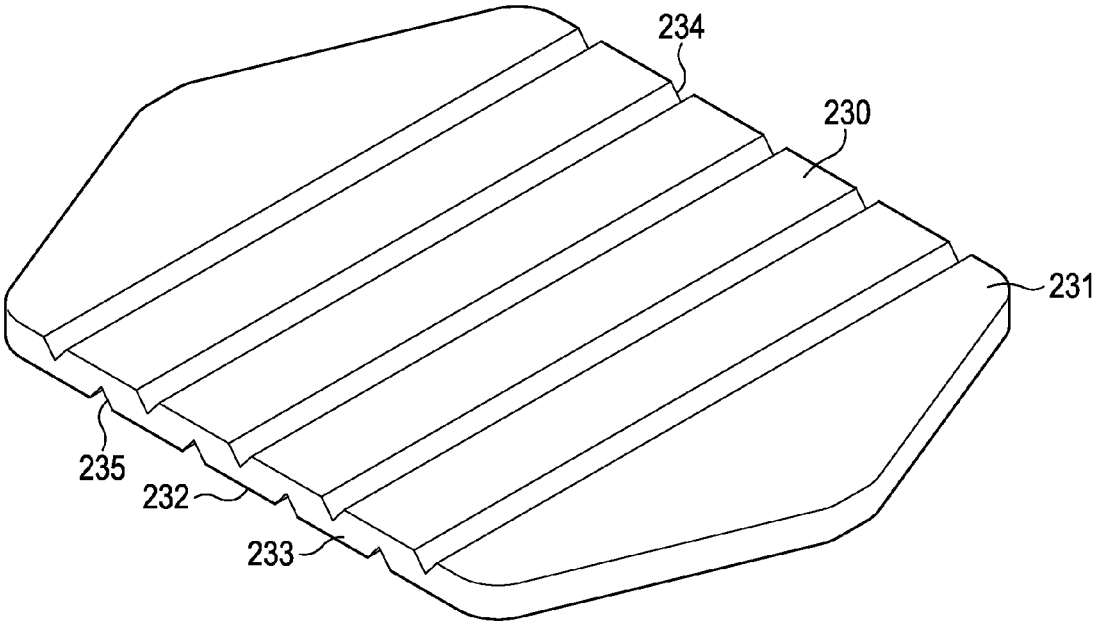
Figure 15D:
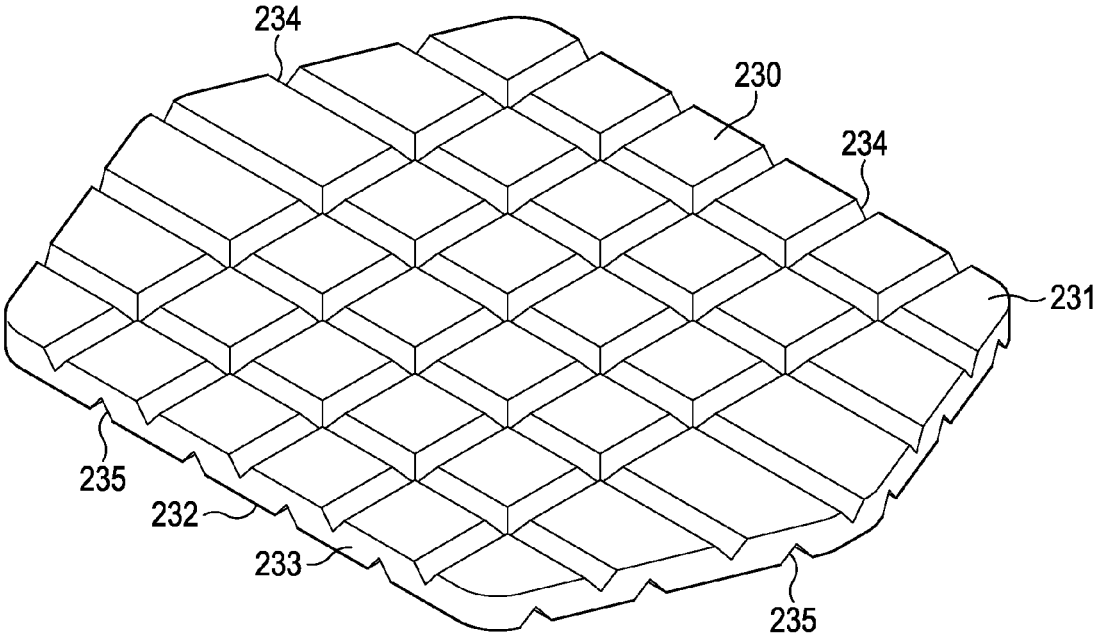
Figure 15E:
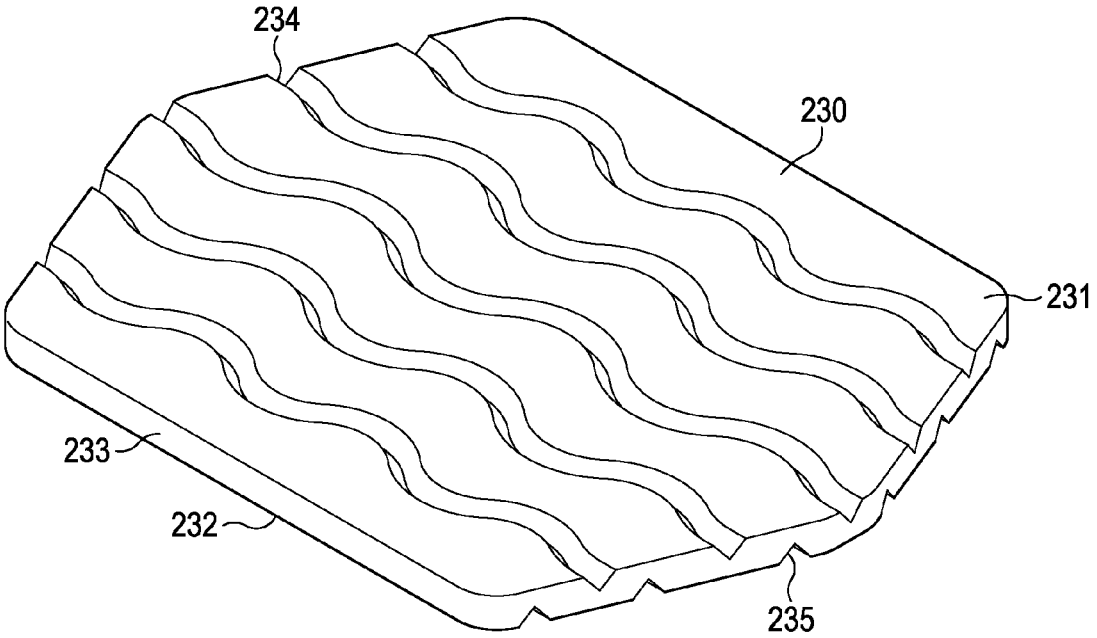
Figure 15F:
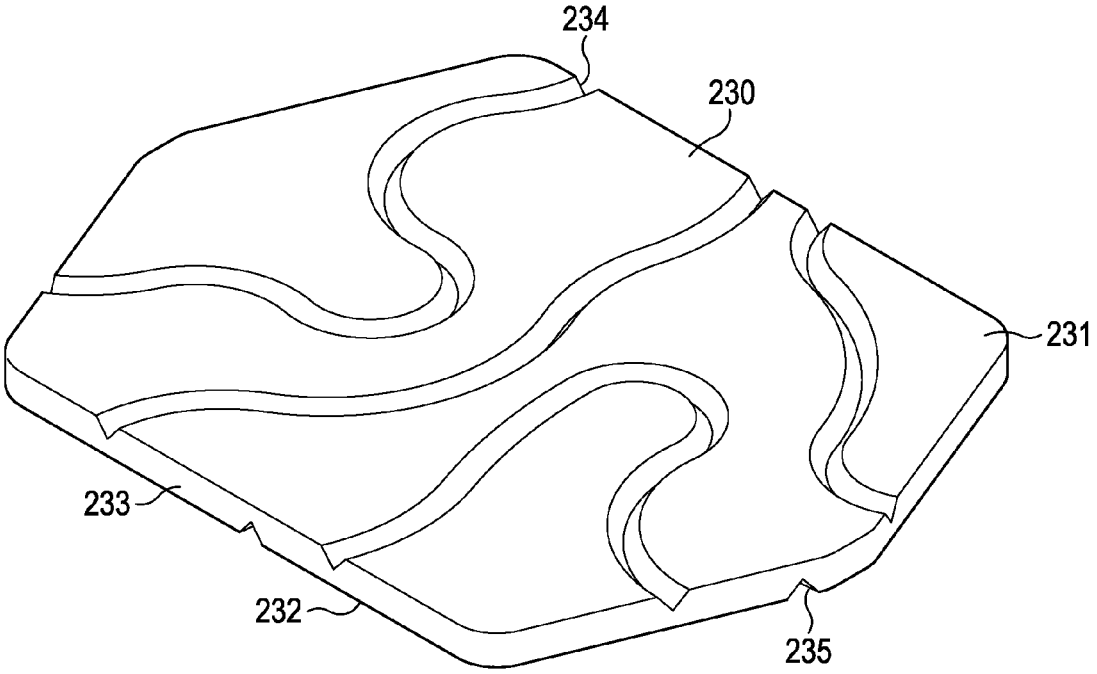
Figure 15G:
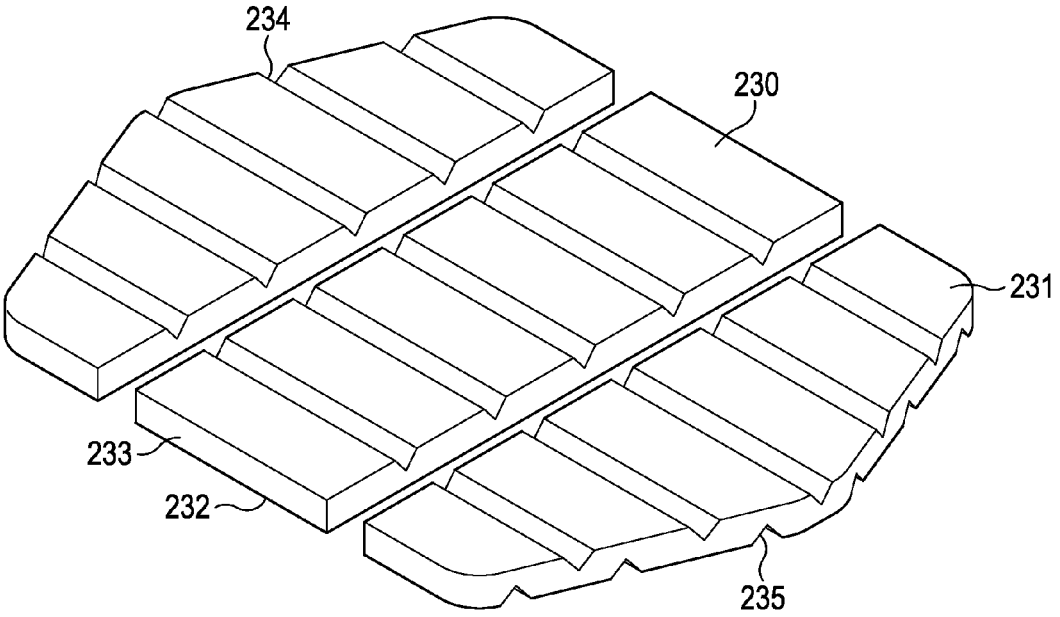

Aspects relating to pad component 230 may also vary to tailor cushioning element 200 to an intended use or enhance the properties of cushioning element 200. As an example, the configuration of grooves 234 and 235 may vary. Referring to FIGS. 15A and 15B, the width of grooves 234 and 235 and the spacing between grooves 234 and 235 are both increased and decreased from the configuration discussed above. Referring to FIG. 15C, grooves 234 and 235 extend across the width of pad component 230, rather than extending across the length. In order to impart flex and stretch in multiple directions, grooves 234 and 235 may have a crossed configuration extending across both the length and width of pad component 230, as depicted in FIG. 15D. Although grooves 234 and 235 may be linear, wavy or non-linear configurations are depicted in FIGS. 15E and 15F. In another configuration, pad component 230 may be segmented or otherwise formed from two or more separate elements. Referring to FIG. 15G, for example, pad component 230 includes three spaced sections, which may enhance the flex and breathability of cushioning element 200.

Figure 15H:
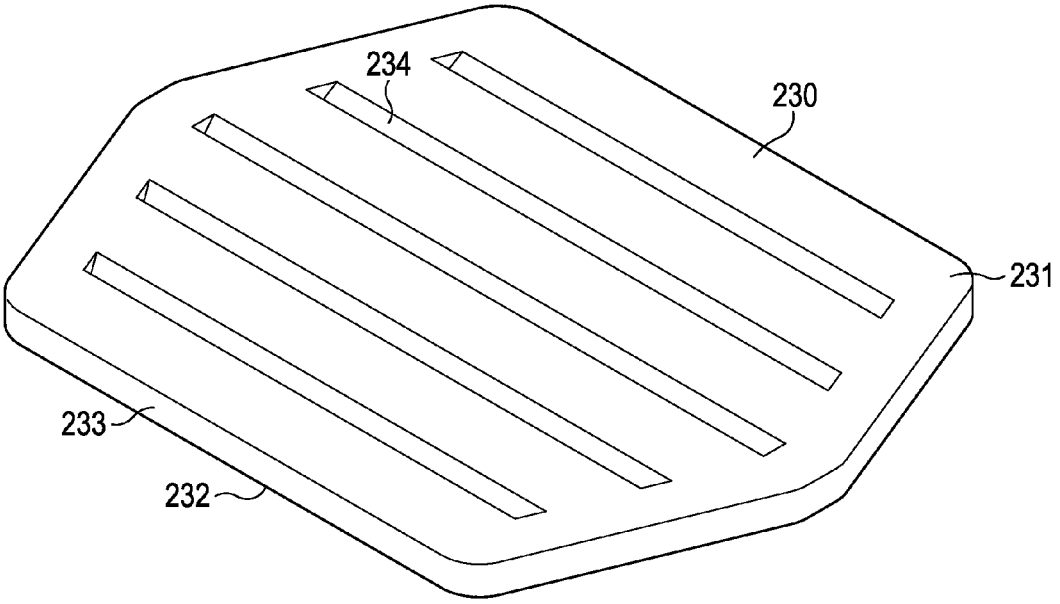
Figure 15I:
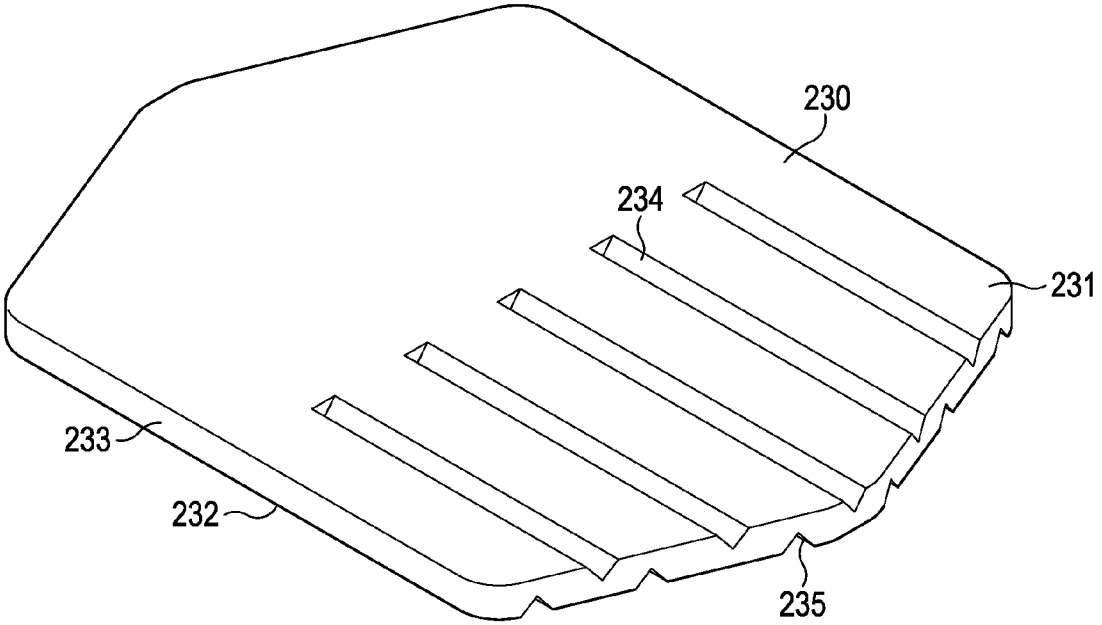
Figure 15J:
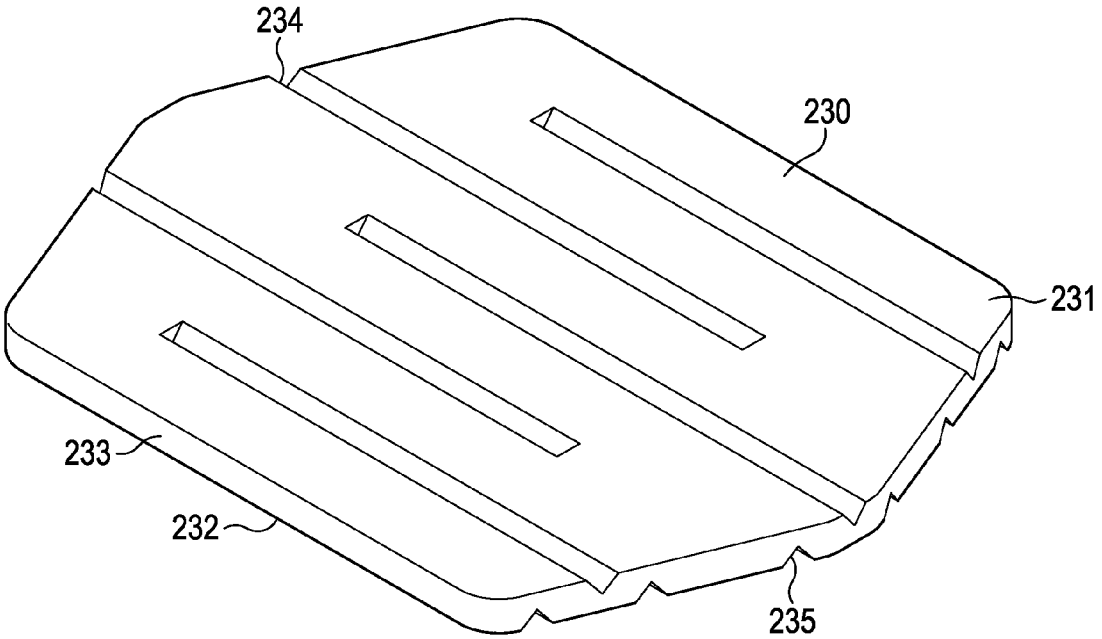

Although grooves 234 and 235 may extend entirely across pad component 230, grooves 234 and 235 may also extend only partially across pad component 230. Referring to FIG. 15H, for example, first grooves 234 extend across a majority of the length of pad component 230, but are spaced from peripheral areas of pad component 230. Second grooves 235 may have a similar configuration. In FIG. 15I, grooves 234 and 235 are located in one region of pad component 230, but are absent from another region of pad component 230. Grooves 234 and 235 may also extend only partially across pad component 230 from opposite sides of pad component 230, as depicted in FIG. 15J. Accordingly, grooves 234 and 235 may have various configurations that extend at least partially across pad component 230.

Figure 16A:
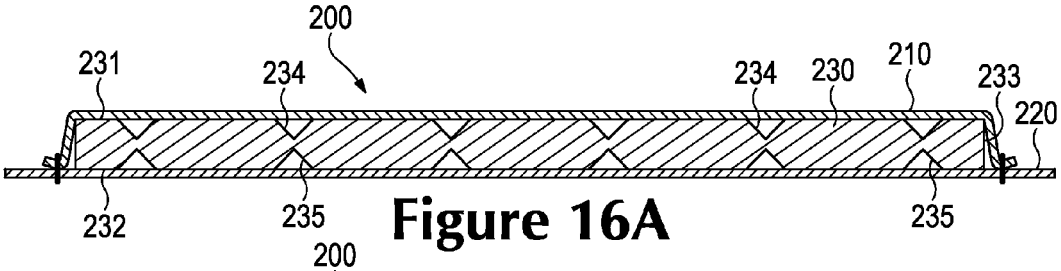
FIGS. 16A-16R are cross-sectional views corresponding with FIG. 9A and depicting further configurations of the cushioning element.
Figure 16B:
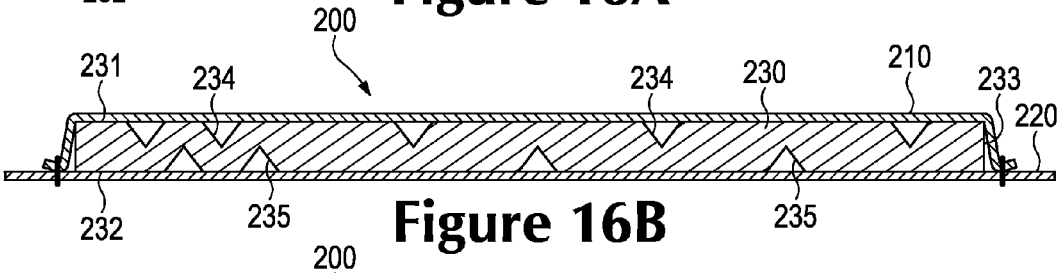
Figure 16C:
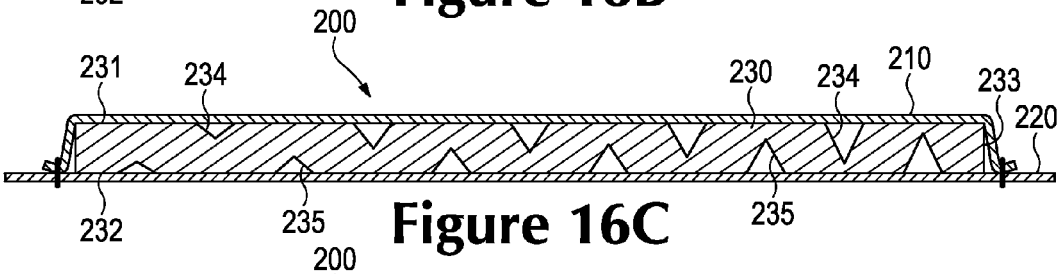
Figure 16D:
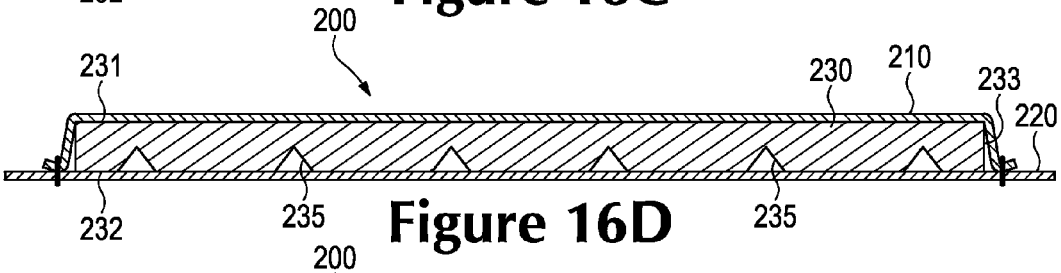

Various aspects relating to the relative size and locations of grooves 234 and 235 may also vary significantly. Referring to FIG. 16A, for example, grooves 234 and 235 are aligned across the thickness of pad component 230, rather than being offset. FIG. 16B depicts a configuration wherein the spacing of grooves 234 and 235 varies across the width of pad component 230, and FIG. 16C depicts a configuration wherein the depth of grooves 234 and 235 varies across the width of pad component 230. Although the depth of grooves 234 and 235 may extend through about fifty percent of the thickness of pad components 230, the depth of grooves 234 and 235 may range from five percent to ninety-five percent of the thickness of pad component 230 in different configurations. In some configurations, first grooves 234 may be absent from pad component 230, as depicted in FIG. 16D, but second grooves 235 may also be absent.

Figure 16E:
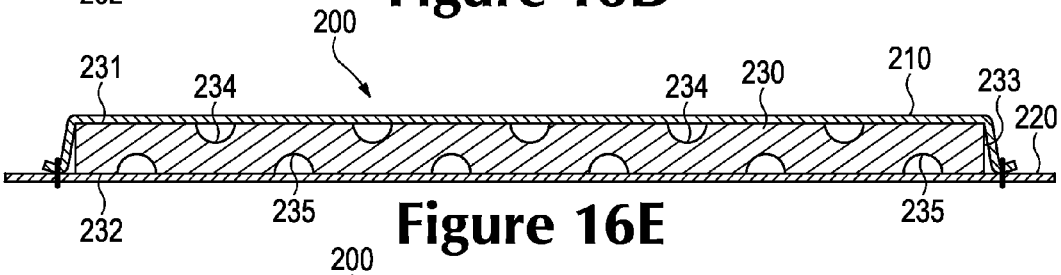
Figure 16F:
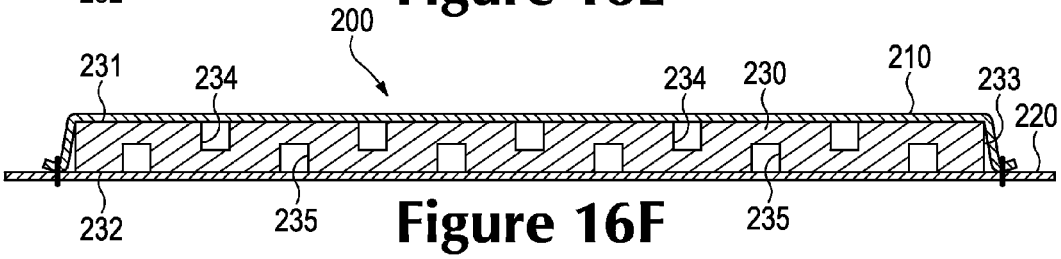
Figure 16G:
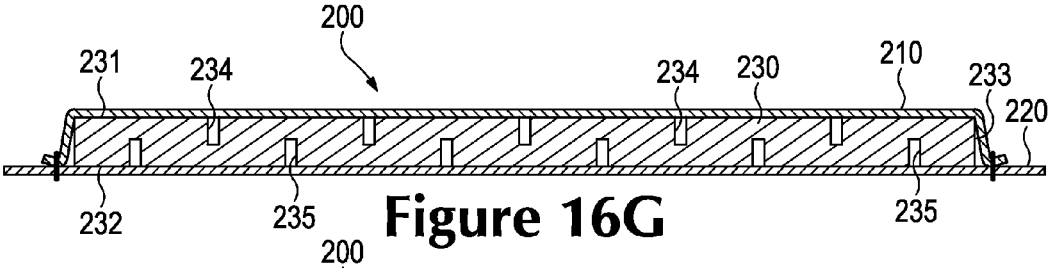
Figure 16H:
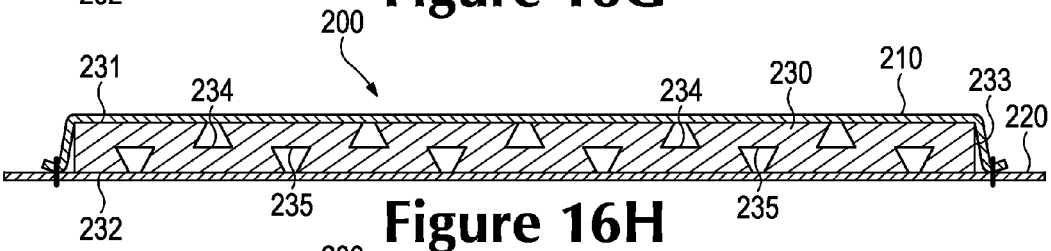
Figure 16I:
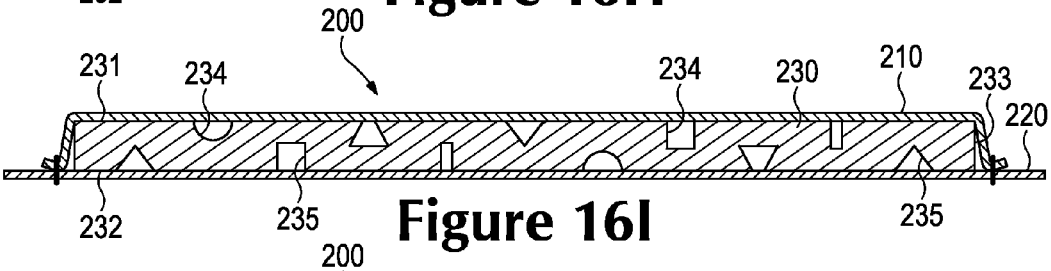

In many of the configurations discussed above, grooves 234 and 235 are depicted as having a triangular, angled, or pointed configuration. Referring to FIG. 16E, grooves 234 and 235 have rounded or semi-circular shapes. Grooves 234 and 235 may also be squared, elongate and rectangular, or dovetailed (i.e., increasing in width as depth increases), as depicted in FIGS. 16F-16H. Various different shapes for grooves 234 and 235 may also be utilized in combination, as depicted in FIG. 16I.

Figure 16J:
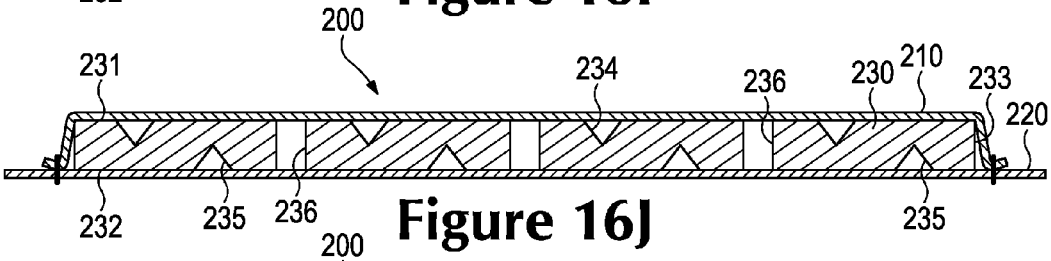
Figure 16K:
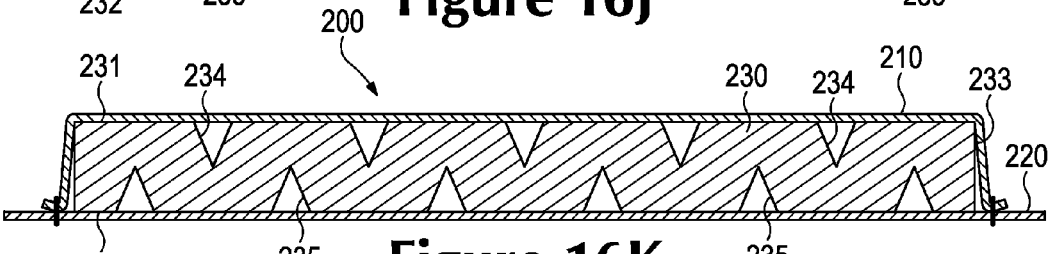
Figure 16L:
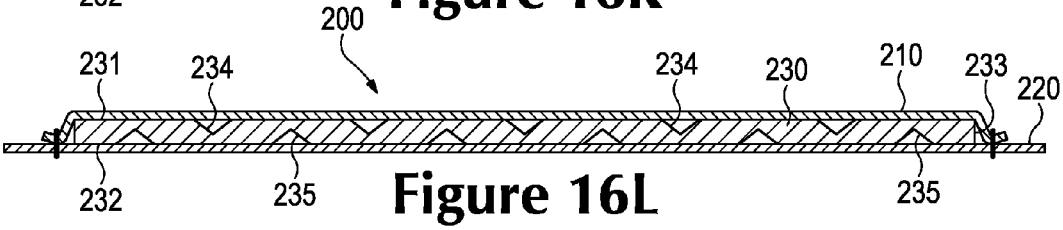
Figure 16M:
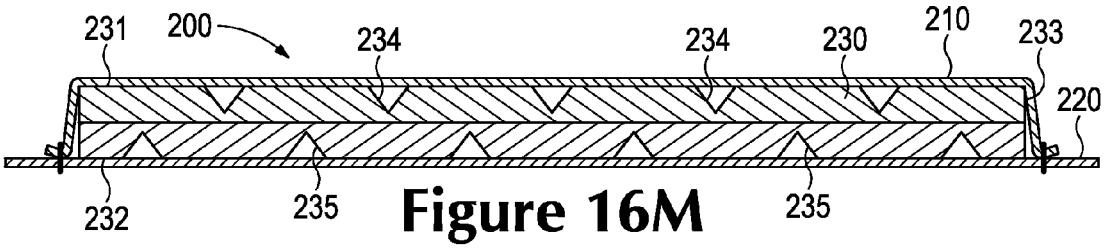
Figure 16N:
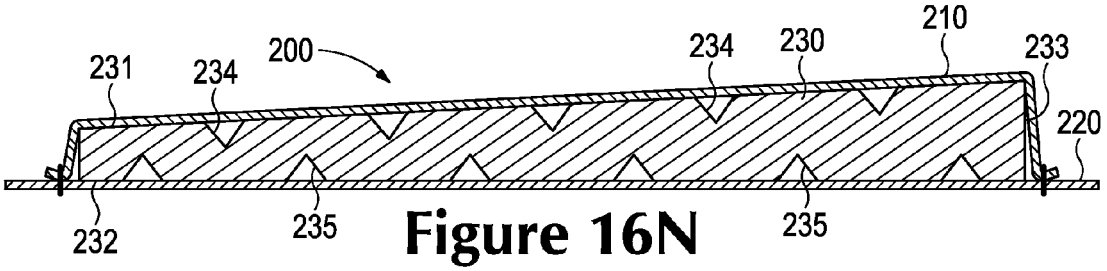
Figure 16O:
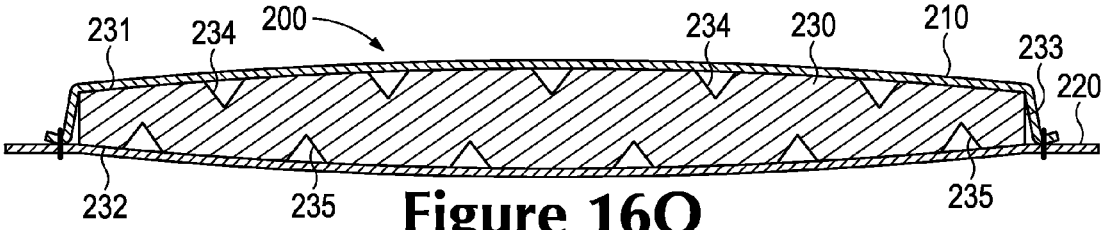
Figure 16P:
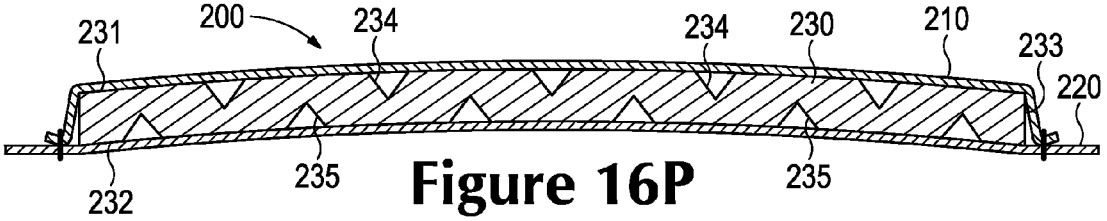

Various additional features may be incorporated into pad component 230. Referring to FIG. 16J, various apertures 236 extend through pad component 230, which may enhance the breathability of cushioning element 200. In some configurations, a greater thickness may be desired, as in FIG. 16K, or a lesser thickness may be desired, as in FIG. 16L. Pad component 230 may also have a layered configuration, as depicted in FIG. 16M. As an example, the layers may be different types or polymer foam or densities of polymer foam, or the layers may be different materials, such as polymer foam and rubber. Although the thicknesses of pad component 230 may be constant, pad component 230 may also have varying or tapered thicknesses, as depicted in FIG. 16N. In some configurations of cushioning element 200, a central area of pad component 230 may have greater thickness than a peripheral area of pad component 230, as depicted in FIG. 16O. Additionally, pad component 230 may have a rounded or contoured shape, as depicted in FIG. 16P.

Figure 16Q:
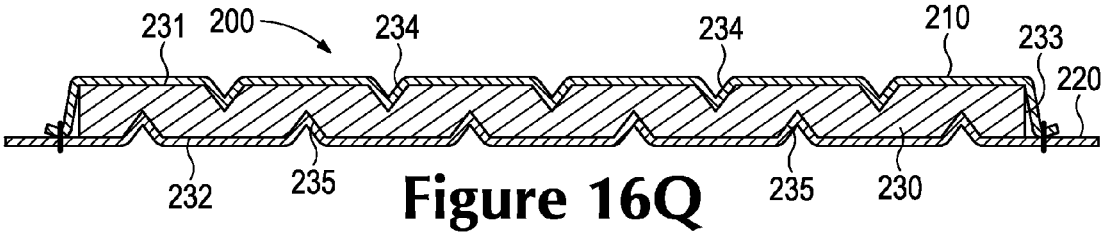

In each of the configurations discussed above, material layers 210 and 220 were absent from grooves 234 and 235. That is, material layers 210 and 220 are not depicted as extending into grooves 234 and 235. Referring to FIG. 16Q, however, material layers 210 and 220 extend into grooves 234 and 235 and are secured to surfaces within grooves 234 and 235. In addition to enhancing flex, stretch, and breathability, this configuration may also present a unique or appealing aesthetic to apparel 100.

Figure 16R:
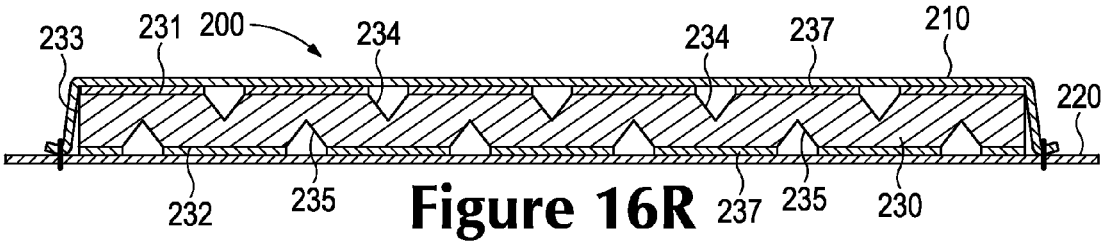

In the manufacturing process discussion above, it was noted that various bonding agents (e.g., adhesives, thermoplastic polymer sheets) may be utilized to bond layers 210 and 220 to pad component 230. Moreover, various methods may be employed to ensure that the bonding agents are limited to the areas of surfaces 231 and 232 that bond with layers 210 and 220. Referring to FIG. 16R, a bonding agent 237 is located between pad component 230 and layers 210 and 220. Moreover, bonding agent 237 is limited to the areas of surfaces 231 and 232 that bond with layers 210 and 220, thereby being absent from side surface 233 and the area within grooves 234 and 235.

Based upon the above discussion, various properties of cushioning element 200 may vary. Depending upon the specific type of apparel or location in the apparel, the properties may impart different degrees of impact force attenuation, flex, stretch, breathability, or other characteristics. As such, the variations discussed above may be utilized individually or in combination to impart particular characteristics to cushioning element 200.

Further Apparel Configurations

Figure 17A:
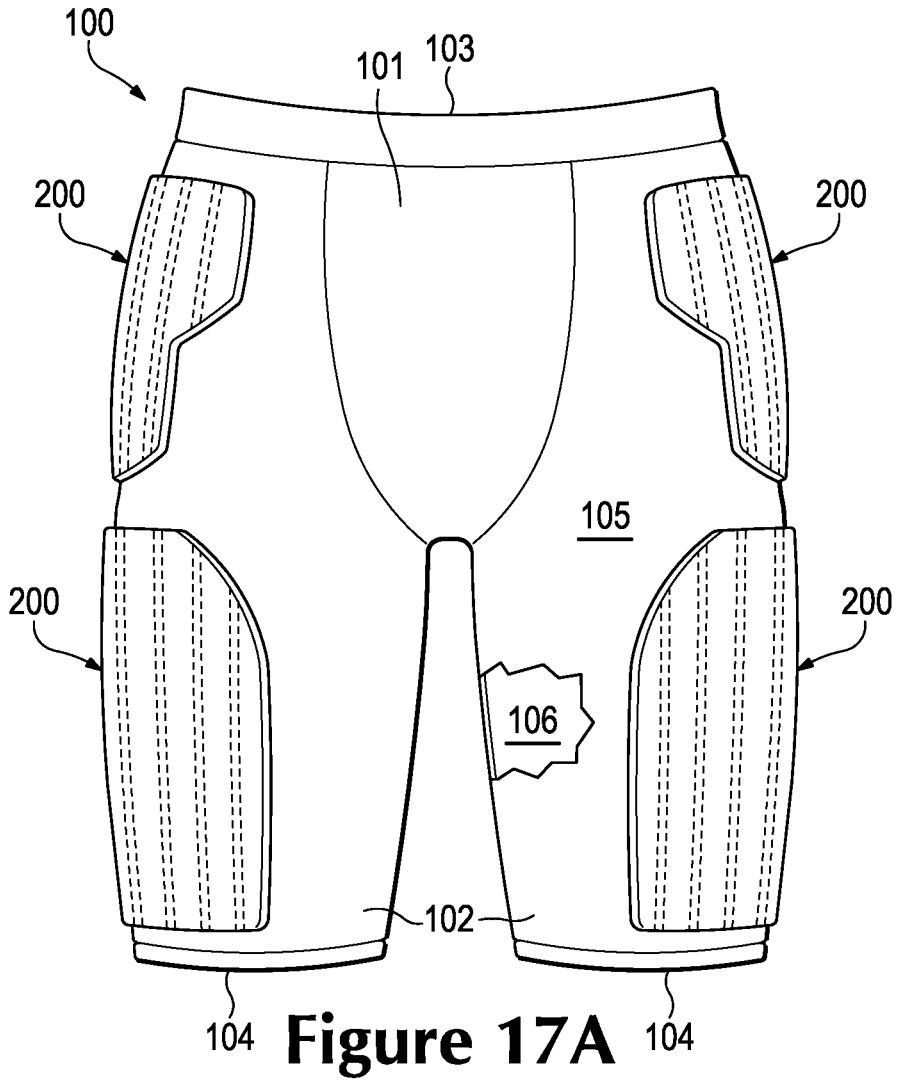
FIGS. 17A-17G are elevational views of further articles of apparel incorporating the cushioning element.
Figure 17B:
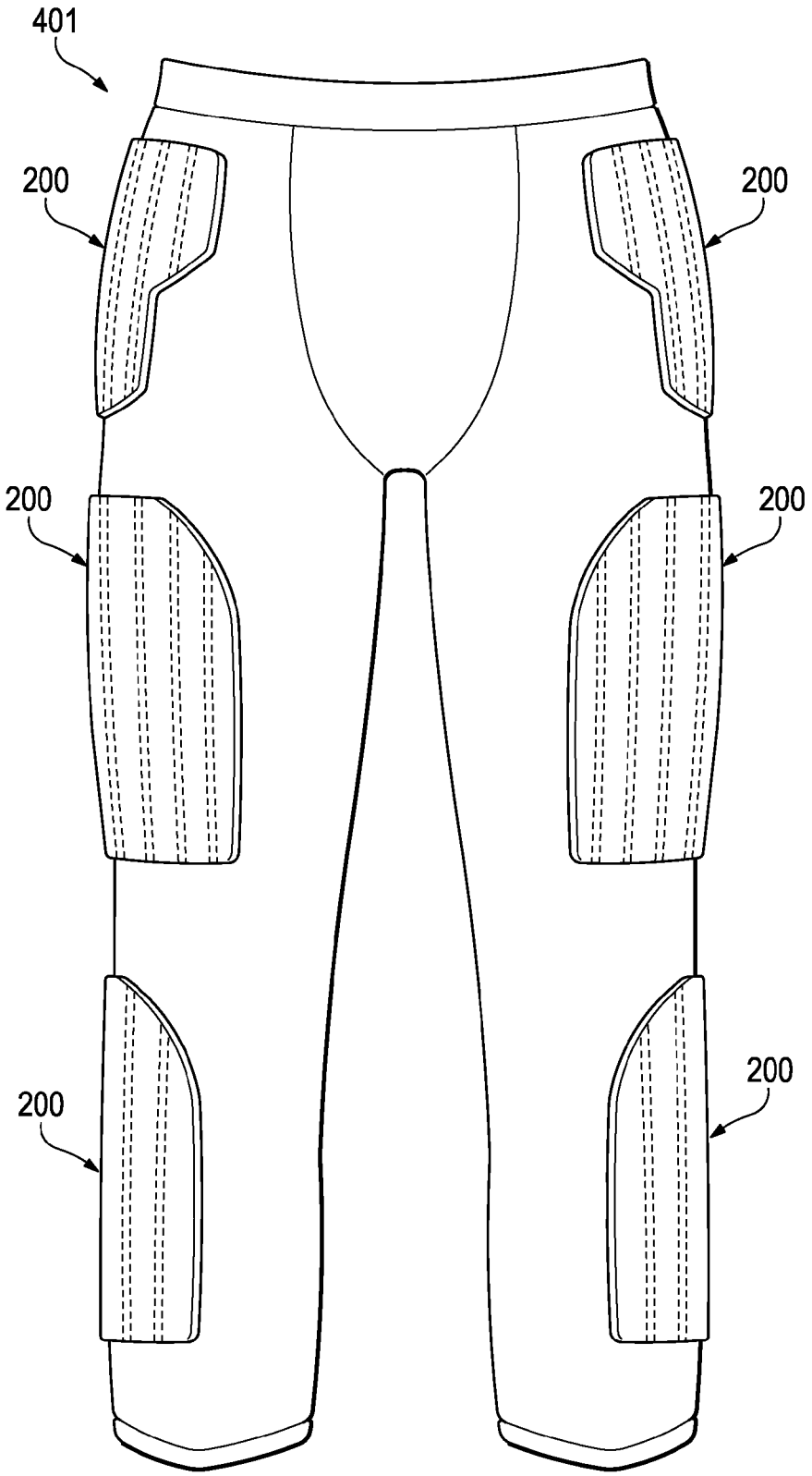
Figure 17C:
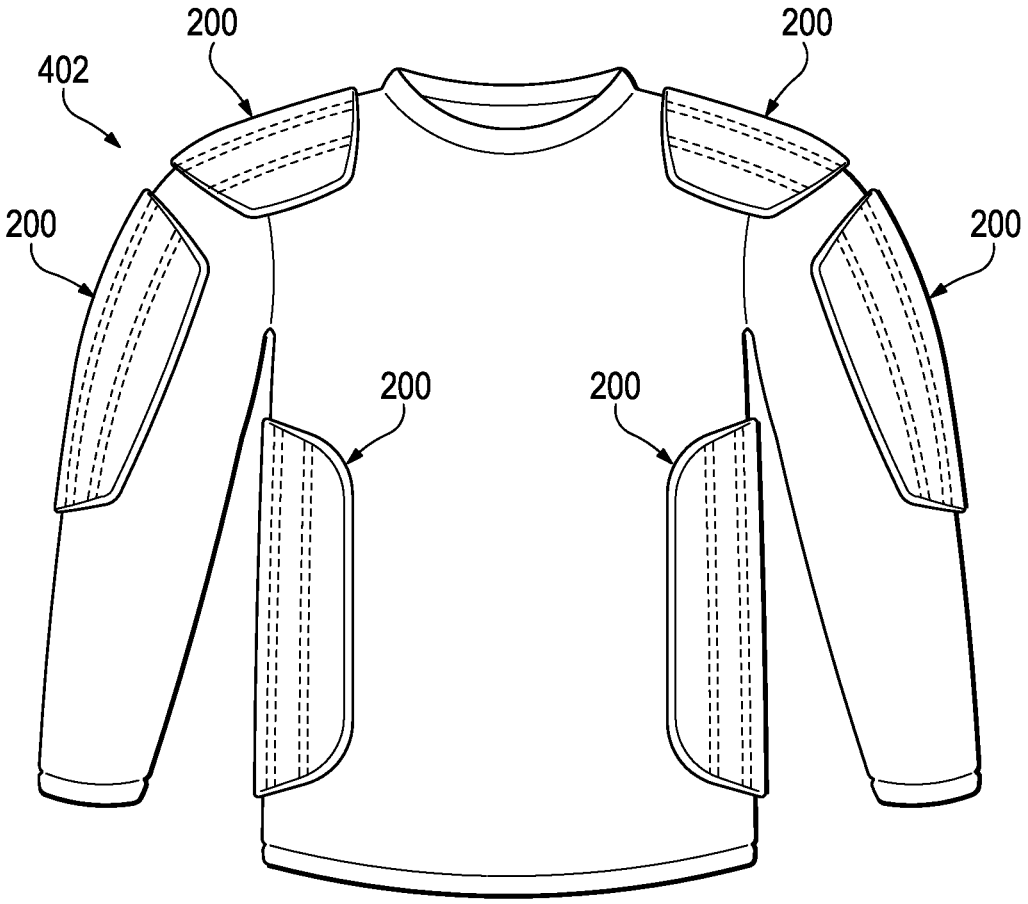

Apparel 100 is depicted as having the general configuration of a pair of shorts. Another shorts configuration is depicted in FIG. 17A and includes the shapes of cushioning elements depicted in FIGS. 14F and 14G. In addition to shorts, the concepts discussed in relation to apparel 100 may be applied to other types of apparel. FIG. 17B, for example, depicts a pair of pants 401 that includes various cushioning elements 200. Referring to FIG. 17C, a shirt 402 is depicted as including various cushioning elements 200 in locations that correspond with the sides, arms, and shoulders of a wearer. Although apparel 402 is depicted as a long-sleeved shirt, apparel 402 may have the configuration of other shirt-type garments, including short-sleeved shirts, tank tops, undershirts, jackets, and coats, for example.

Figure 17D:
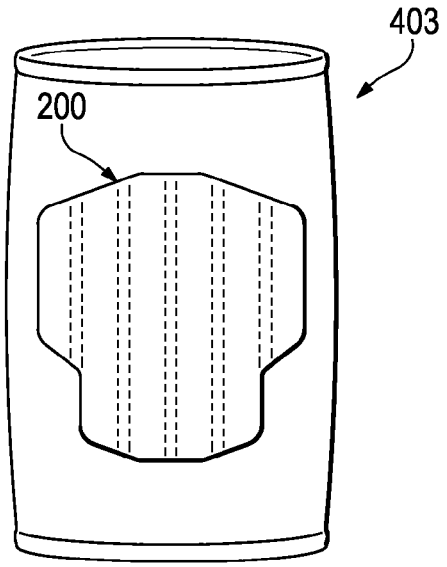
Figure 17E:
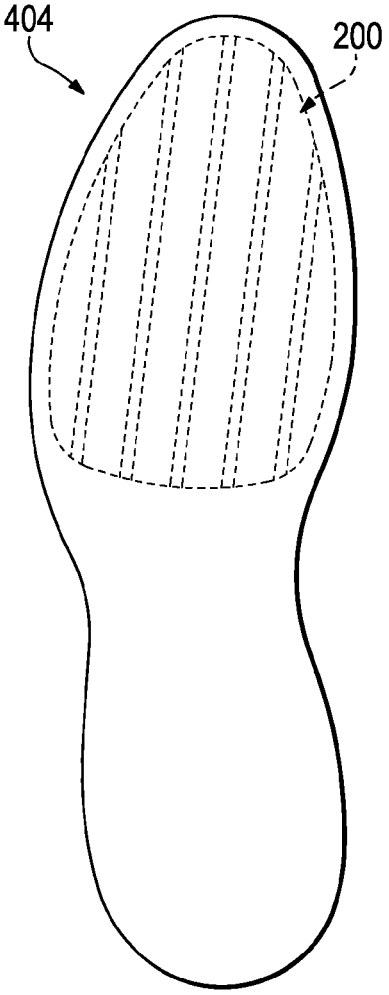
Figure 17F:
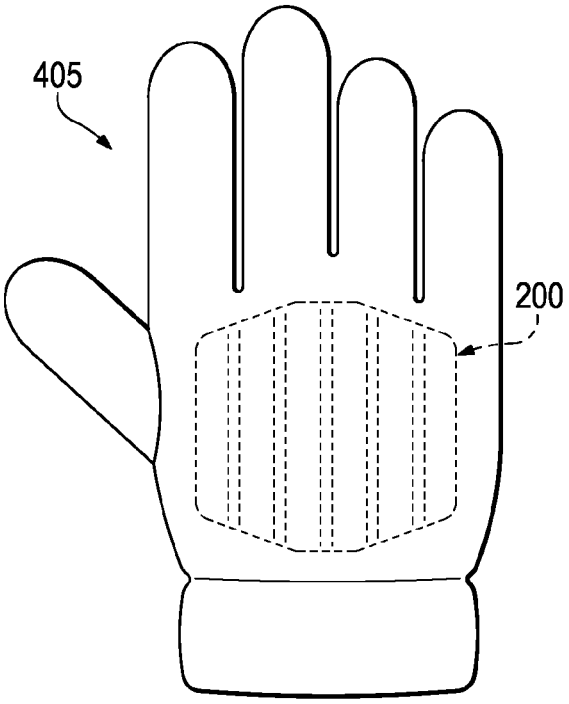
Figure 17G:
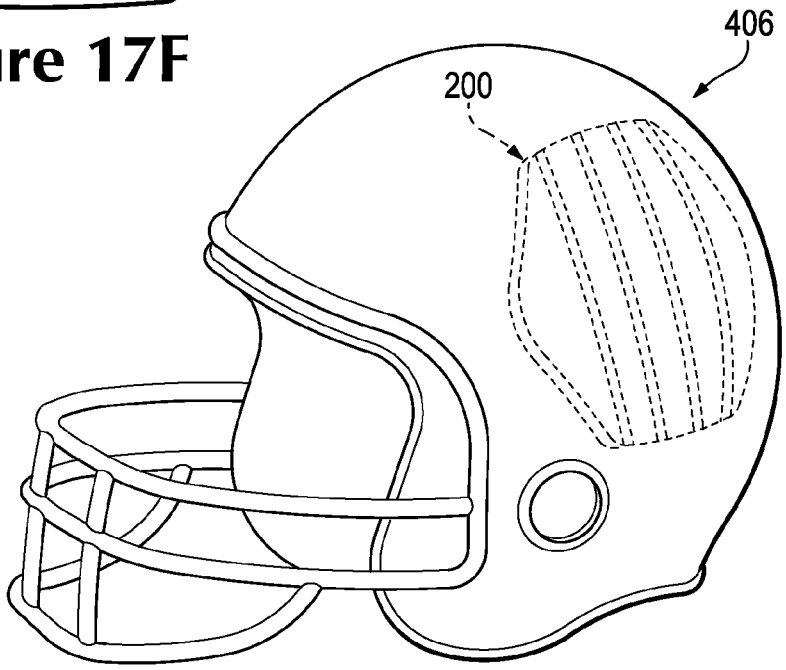

Cushioning elements 200 may also be incorporated into apparel that covers other areas of the wearer, such as hats, wraps, footwear, socks, gloves, and helmets, for example. As an example, a wrap 403 with one cushioning element 200 is depicted in FIG. 17D. Wrap 403 has a generally cylindrical configuration that may be placed upon an arm or a leg of a wearer. When, for example, the elbow is sore or injured, cushioning element 200 of wrap 403 may be located over the elbow to assist with protecting the elbow during athletic activities. As another example, a sockliner 404 that incorporates a cushioning element 200 is depicted in FIG. 17E. Sockliner 404 may be located within an article of footwear to cushion a lower surface of the foot. Additionally, one or more cushioning elements 200 may be incorporated into a glove 405, as depicted in FIG. 17F, to impart protection to a hand of the wearer. One or more cushioning elements 200 may also be incorporated into a helmet 406, as depicted in FIG. 17G, to impart protection to a head of the wearer. In addition to attenuating impact forces, cushioning elements 200 in these configurations may also simultaneously provide one or more of flex, stretch, breathability, a relatively low overall mass, and launderability.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel incorporating at least one cushioning element for attenuating impact forces, the cushioning element comprising:

a first material layer and a second material layer; and a pad component located between the first material layer and the second material layer, the pad component including a first surface and an opposite second surface and having a pad thickness extending between the first surface and the opposite second surface, the first surface facing the first material layer, and the second surface facing the second material layer, and the first surface including a plurality of elongate grooves that extend partially through the pad thickness from the first surface toward the second surface and at least partially across the pad component, wherein at least two grooves of the plurality of elongate grooves are spaced apart from one another by a portion of the pad component, the portion of the pad component having a width that is at least as wide as an elongate groove of the at least two grooves.

2. The article of apparel recited in claim 1, wherein the second surface includes a plurality of grooves that extend partially through the pad thickness from the second surface toward the first surface and at least partially across the pad component.

3. The article of apparel recited in claim 2, wherein the grooves in the first surface are (a) offset from the grooves in the second surface and (b) parallel to the grooves in the second surface.

4. The article of apparel recited in claim 1, wherein the first surface is secured to the first material layer and the second surface is secured to the second material layer.

5. The article of apparel recited in claim 1, wherein the grooves extend entirely across the pad component.

6. The article of apparel recited in claim 1, wherein the grooves have an angled configuration.

7. The article of apparel recited in claim 1, wherein the first material layer forms at least a portion of an exterior surface of the article of apparel.

8. The article of apparel recited in claim 7, wherein the second material layer forms at least a portion of an interior surface of the article of apparel.

9. The article of apparel recited in claim 1, wherein the first material layer is joined to the second material layer.

10. The article of apparel recited in claim 1, wherein the pad component includes a polymer foam material.

11. An article of apparel incorporating at least one cushioning element for attenuating impact forces, the cushioning element comprising:

a first material layer and a second material layer; and a pad component located between the first material layer and the second material layer, the pad component including a first surface comprising a plurality of first grooves, wherein at least two grooves of the plurality of first grooves are separated from one another by a portion of the first surface, the portion of the first surface being secured to the first material layer, and the pad component including a second surface located opposite the first surface, and comprising a plurality of second grooves, wherein at least two grooves of the plurality of second grooves are separated from one another by a portion of the second surface, wherein the first grooves are offset from the second grooves.

12. The article of apparel recited in claim 11, wherein the first grooves are parallel to the second grooves.

13. The article of apparel recited in claim 11, wherein the first grooves extend entirely across the pad component.

14. The article of apparel recited in claim 11, wherein the grooves have a V-shaped configuration.

15. The article of apparel recited in claim 11, wherein the first material layer forms at least a portion of an exterior surface of the article of apparel.

16. The article of apparel recited in claim 15, wherein a portion of the second material layer secured to the pad component is located inward of the first material layer.

17. The article of apparel recited in claim 15, wherein a portion of the second material layer spaced from the pad component forms a portion of the exterior surface of the apparel.

18. The article of apparel recited in claim 11, wherein the first material layer is joined to the second material layer around a periphery of the pad component.

19. The article of apparel recited in claim 11, wherein the first material layer and the second material layer are textile materials and the pad component includes a polymer foam material.

20. The article of apparel recited in claim 11, wherein the first grooves extend through approximately fifty percent of a distance between the first surface and the second surface of the pad component.

21. An article of apparel incorporating at least one cushioning element for attenuating impact forces, the cushioning element comprising:

a first material layer that forms a portion of an exterior surface of the apparel, the first material layer being formed from an air-permeable material;

a second material layer located inward of the first material layer, the second material layer being formed from an air-permeable material; and a pad component located between the first material layer and the second material layer, the pad component including a first surface comprising a plurality of first grooves, wherein at least two grooves of the plurality of first grooves are separated from one another by a portion of the first surface, the portion of the first surface being secured to the first material layer and the at least two grooves being detached from the first material layer, and the pad component including a second surface located opposite the first surface and comprising (b) a plurality of second grooves, wherein at least two groove of the plurality of second grooves are separated from one another by a portion of the second surface, the second surface being detached from the second material, the first grooves being substantially parallel to the second grooves.

22. The article of apparel recited in claim 21, wherein at least a portion of the first grooves and the second grooves are offset.

23. The article of apparel recited in claim 21, wherein the first grooves and the second grooves extend entirely across the pad component.

24. The article of apparel recited in claim 21, wherein at least one of the first grooves and the second grooves have a V-shaped configuration.

25. The article of apparel recited in claim 21, wherein a portion of the second material layer that is spaced from the pad component forms a portion of the exterior surface of the apparel.

26. The article of apparel recited in claim 21, wherein the first material layer is joined to the second material layer around a periphery of the pad component.

27. The article of apparel recited in claim 21, wherein the first material layer and the second material layer are textile materials and the pad component includes a polymer foam material.

28. The article of apparel of claim 21, wherein the first material layer includes a pad-facing surface that faces towards the first surface of the pad component, the pad-facing surface of the first material layer being attached to the portion of the first surface and detached from the at least two grooves, and wherein the second material layer includes a pad-facing surface that faces towards the second surface of the pad component, the pad-facing surface of the second material layer being detached from the second surface and from the at least two grooves of the plurality of second grooves.

29. The article of apparel of claim 11, wherein the first material layer is attached at the first plurality of portions of the pad component and detached from the plurality of first grooves and the second material layer is attached at the second plurality of portions of the pad component and detached from the plurality of second grooves.

* * * * *